US009302400B2

(12) United States Patent
Michel

(10) Patent No.: US 9,302,400 B2
(45) Date of Patent: Apr. 5, 2016

(54) ATTACHMENT GUIDE COMB CONDUIT

(71) Applicant: Matthew Justin Michel, Los Angeles, CA (US)

(72) Inventor: Matthew Justin Michel, Los Angeles, CA (US)

( * ) Notice: Subject to any disclaimer, the term of this patent is extended or adjusted under 35 U.S.C. 154(b) by 347 days.

(21) Appl. No.: 13/892,886

(22) Filed: May 13, 2013

(65) Prior Publication Data

US 2014/0331504 A1 Nov. 13, 2014

Related U.S. Application Data

(63) Continuation-in-part of application No. 12/422,993, filed on Apr. 14, 2009, now Pat. No. 8,439,190, which is a continuation-in-part of application No. 11/470,256, filed on Sep. 6, 2006, now Pat. No. 7,536,789.

(51) Int. Cl.

| | |
|---|---|
| ***B26B 19/38*** | (2006.01) |
| ***B26B 13/24*** | (2006.01) |
| ***B26B 19/20*** | (2006.01) |
| ***B26B 19/40*** | (2006.01) |
| ***B26B 19/44*** | (2006.01) |
| ***B26B 21/12*** | (2006.01) |
| ***A45D 19/02*** | (2006.01) |
| ***A45D 20/12*** | (2006.01) |
| ***A45D 24/22*** | (2006.01) |
| ***A45D 24/36*** | (2006.01) |

(52) U.S. Cl.

CPC ..... *B26B 19/3813* (2013.01); *A45D 19/02* (2013.01); *A45D 20/12* (2013.01); *A45D 24/22* (2013.01); *A45D 24/36* (2013.01); *B26B 13/24* (2013.01); *B26B 19/20* (2013.01); *B26B 19/3806* (2013.01); *B26B 19/3826* (2013.01); *B26B 19/40* (2013.01); *B26B 19/44* (2013.01); *B26B 21/12* (2013.01); *Y10T 29/49826* (2015.01)

(58) Field of Classification Search

CPC ..... A45D 19/02; A45D 20/12; A45D 24/22; A45D 24/36; B26B 13/24; B26B 19/20; B26B 19/386; B26B 19/3813; B26B 19/3826; B26B 19/40; B26B 19/44; B26B 21/12; Y10T 29/49826

See application file for complete search history.

(56) References Cited

U.S. PATENT DOCUMENTS

| | | | | |
|---|---|---|---|---|
| 84,860 | A | 12/1868 | Craig | |
| 1,004,404 | A | 9/1911 | Fordyce | |
| 1,558,729 | A | 10/1925 | Wahl | |
| 1,570,013 | A * | 1/1926 | Smith | 132/114 |
| 1,878,345 | A | 9/1932 | Suter | |
| 1,957,430 | A | 5/1934 | Adelmo | |
| 2,108,184 | A | 2/1938 | Wallenius | |
| 2,748,472 | A | 6/1956 | Sheley | |
| 2,780,829 | A | 2/1957 | Cohen | |
| 3,308,500 | A | 3/1967 | Woodruff | |

(Continued)

*Primary Examiner* — Hwei C Payer

(57) ABSTRACT

A dummy hair clipper head, or dummy blade, which is a form conforming to those dimensions of a hair clipper's stationary blade which are necessary for its compatibility with attachment guide combs, is employed in a conduit comb which comprises a form configured to allow air or liquid to pass through the form and between the teeth of the attachment guide comb, whereby an attachment guide comb can be employed in vacuuming, drying, washing and treating hair. The form can be connected in turn to a bottle, air hose, or faucet to allow for the transmission of air or liquid through the comb. The use of the form also makes possible a variety of new uses for attachment guide combs including a scissor comb, razor comb, and comb organizer.

21 Claims, 14 Drawing Sheets

(56) References Cited

U.S. PATENT DOCUMENTS

| | | | | | |
|---|---|---|---|---|---|
| 3,344,520 | A | * | 10/1967 | Williams | 30/200 |
| 3,429,642 | A | * | 2/1969 | Underwood | 401/16 |
| 3,520,311 | A | | 7/1970 | Lesersek | |
| 3,626,546 | A | | 12/1971 | Dove | |
| 3,668,736 | A | | 6/1972 | Loscalzo | |
| 3,696,818 | A | | 10/1972 | Weber | |
| 3,937,231 | A | | 2/1976 | Tucker | |
| 3,964,501 | A | * | 6/1976 | Matchett | 132/112 |
| D244,712 | S | | 6/1977 | Houston | |
| 4,538,362 | A | | 9/1985 | Andis | |
| 4,813,439 | A | | 3/1989 | Morgan | |
| 5,095,853 | A | | 3/1992 | Kruger | |
| 5,195,245 | A | | 3/1993 | Malone | |
| 5,649,502 | A | | 7/1997 | Frank | |
| 5,768,748 | A | | 6/1998 | Silvera | |
| 5,937,526 | A | | 8/1999 | Wahl | |
| 6,079,107 | A | | 6/2000 | Hovarth | |
| 6,302,607 | B1 | | 10/2001 | Burrowes | |
| 6,367,483 | B1 | * | 4/2002 | Chen et al. | 132/112 |
| 6,675,812 | B1 | * | 1/2004 | Wiley | 132/108 |
| 6,775,922 | B2 | | 8/2004 | Langley | |
| 6,807,736 | B2 | | 10/2004 | Langley | |
| 7,044,137 | B2 | * | 5/2006 | Glucksman et al. | 132/114 |
| D545,500 | S | | 6/2007 | McCambridge | |
| D548,888 | S | | 8/2007 | McCambridge | |
| 7,536,789 | B2 | * | 5/2009 | Michel | 30/200 |
| 8,439,190 | B2 | * | 5/2013 | Michel | 206/228 |
| 8,597,435 | B2 | * | 12/2013 | Schreiber | 134/166 R |
| 2014/0331504 | A1 | * | 11/2014 | Michel | 30/233.5 |

* cited by examiner

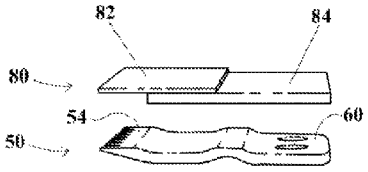
FIG 18
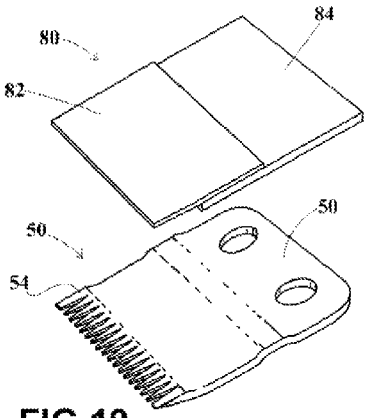
FIG 19
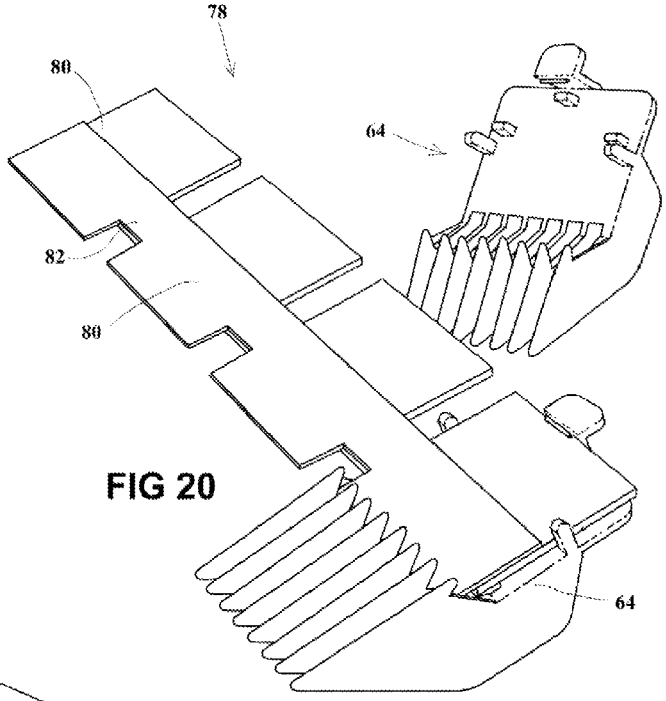
FIG 20
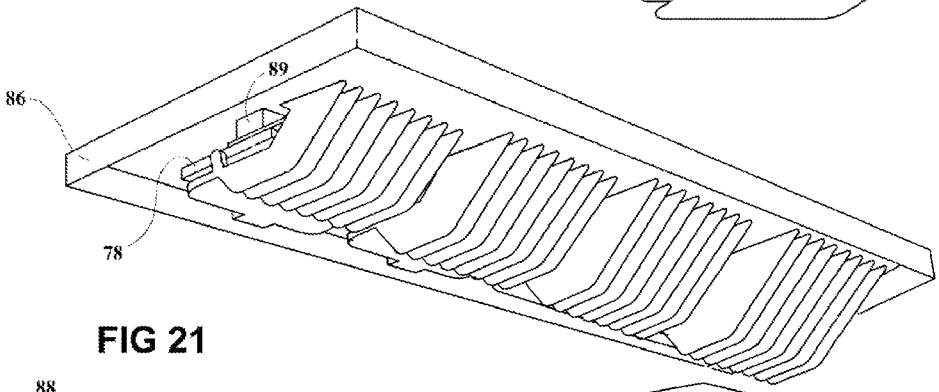
FIG 21
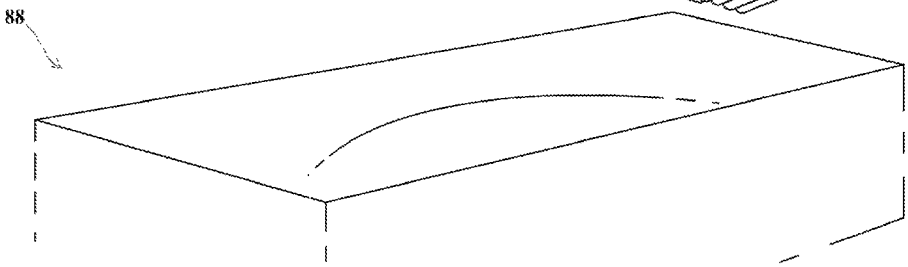

132
134
121
64

138
136

142
140
136

146
144
136
120
64

ATTACHMENT GUIDE COMB CONDUIT

CROSS-REFERENCE TO RELATED APPLICATION

This application is a continuation in part of U.S. patent application Ser. No. 12/422,993, filed Apr. 14, 2009, now U.S. Pat. No. 8,439,190, which was a continuation-in-part application of the parent application Ser. No. 11/470,256, filed Sep. 6, 2006, now U.S. Pat. No. 7,536,789, the entire disclosure of which is incorporated by reference for any and all purposes.

FIELD OF THE INVENTION

The present invention relates to the conduction of fluent material, such as air and liquid, through attachment guide combs, of the type having a V-shaped groove, by their attachment to a compatible form configured for that purpose.

BACKGROUND OF THE INVENTION

Before giving the background of the embodiments of the present invention it is first important to understand the background of attachment guide combs of the type having a V-shaped groove and their use with electric hair clippers.

The hair clipper kit found in most homes today includes an electric hair clipper and a set of four to ten attachment guide combs of different lengths, all stored loose in a box. A typical example of the hair clipper kit is shown in the 2004 Langley U.S. Pat. No. 6,807,736. FIG. 4 shows a typical hair clipper with attachment guide comb attached and FIGS. 10-17 show an attachment guide comb from all angles.

The hair clipper has changed little since the 1925 WAHL U.S. Pat. No. 1,558,729. It has a moving blade that reciprocates against a stationary blade. The stationary blade is rectangular with protruding edges. The accessory attachment guide combs snap onto the stationary blade, secured at its edges, and allow the operator to cut hair to a chosen length.

The stationary blade has a design ideally suited to its function. The attachment guide combs have been subsequently designed to be compatible with these dimensions. The present design was earlier taught in the 1934 Adelmo U.S. Pat. No. 1,957,430 and was more recently taught in the 1999 Wahl U.S. Pat. No. 5,937,526.

An essential grooming tool, there are a wide variety of hair clipper kits and attachment guide combs available today. Across most makes and models the stationary blade of the hair clipper maintains the same dimensions, allowing the attachment guide combs to be interchangeable.

The attachment guide comb has five principal advantages over the standard flat comb: selectable length, easy attachment, stable support, lifting teeth and an unobstructed path for hair.

Selection of the length of hair cut by attaching the appropriate attachment guide comb has made it possible for unskilled operators to use an electric hair clipper to achieve a hair cut of uniform length. Once in place, the attachment guide comb prevents the blade from getting closer to the scalp than the length of the attachment guide comb teeth will allow.

Easy attachment to the head of the hair clipper allows an unskilled operator to quickly attach attachment guide combs. Only one hand is required once the attachment guide comb is attached.

The stable support provided by the attached guide comb means that the clipper will not rock or wobble in any direction when resting on the scalp. The attachment guide comb is designed with teeth that form a rectangular base of support as wide as the hair clipper and with a length typically between ½ inch up to a few inches depending on the size of the attachment guide comb.

The teeth of the attachment guide comb lift the hair to the blade. The teeth of the attachment guide comb are very different from the teeth of a standard flat comb. The teeth of the standard flat comb are rods while the attachment guide comb's teeth are flat walls which rise from the scalp all the way up to the cutting blade. The attachment guide comb is pushed through the hair which is gathered into the comb. The strands of hair are then supported by these vertical teeth as the hair is cut.

Finally, with an attachment guide comb the path for the uncut hair beneath the clipper blade is unobstructed. This means that hair can be gathered into the comb and pass through it without encountering obstructions. This allows the attachment guide comb to be pulled smoothly through the hair. This unobstructed path is made possible by the position of the back of the attachment guide comb, to which all the teeth are attached. The back of the comb is positioned above and behind the blade of the clipper and does not come into contact with the hair.

There is one problem with the means by which the attachment guide combs attach to the stationary blade of the hair clipper. It is that the leading edge of the clipper, which consists of a series of small teeth, must support the larger teeth of the attachment guide comb. This requires the attachment guide comb teeth to be positioned so as to line up with the ends of the stationary blade's teeth. Unfortunately the attachment guide comb's teeth, being flexible, can slip off the supporting small metal teeth of the guide comb, losing its support and bending to one side.

The present invention is focused on the conduit form for attachment guide combs, which can be used as a vacuum comb, a dryer comb and a liquid dispensing comb. Also included in the specification and drawings are: the comb organizer, the scissor comb and the razor comb. The background of each of these tools is as follows.

The attachment of a comb to a pair of scissors has been developed for two reasons: to prevent the scissors from cutting skin and to regulate the length of hair cut.

The 1993 Malone U.S. Pat. No. 5,195,245 teaches safety scissors with a comb adjacent to the blade edge. This scissor comb effectively prevents anything that cannot fit between the comb teeth from reaching the blade. This design was not intended to regulate the length of hair cut and lacks this advantage.

Designed to regulate the length of hair cut, the 1868 Craig U.S. Pat. No. 84,860 taught a comb which attached to a pair of scissors, the distance between the two being adjustable by a sliding support. The 1911 Fordyce U.S. Pat. No. 1,004,404 taught a clip-on comb attachment that could be quickly detached by a spring clip. The 2000 Horvath U.S. Pat. No. 6,079,107 teaches a pair of scissors with a comb contemplated for use in trimming facial hair. All three designs have comb backs at surface level obstructing the path for the uncut hair and would therefore not pull smoothly through the hair.

The attachment of a comb to a razor blade for the purpose of cutting hair has the advantages of being economical, simple to use, and silent (an advantage in pet grooming). Examples include the 1908 Owens U.S. Pat. No. 892,679, which taught a comb designed to be clipped on to a straight razor, and the 1909 Becker U.S. Pat. No. 919,307, which taught a holder that held a common safety razor against a common comb. The 1987 Custer U.S. Pat. No. 4,663,841 taught an economical safety razor holder with a sliding comb member which permitted limited adjustment of the comb length. The Custer design has both a narrow support base and a comb back at surface level and would therefore not work well being pulled through the hair.

The attachment of a comb to a vacuum source to clean the hair has the advantage of dislodging more material by agitating the hair. It is important that the length of the comb's teeth correspond to the thickness of the hair. If the teeth are too short they will only partially penetrate the hair. If the teeth are too long the vacuum will lose suction through the gap between the surface of the hair and the vacuum inlet.

Many vacuum combs have addressed cleaning a single length of hair. The 1932 Suter U.S. Pat. No. 1,878,345 and the 1957 Cohen U.S. Pat. No. 2,780,829 both teach short toothed vacuum attachments intended for use on the short haired coats of horses. The 1992 Kruger U.S. Pat. No. 5,095,853 and the 1998 Silvera U.S. Pat. No. 5,768,748 both teach vacuum attachments with long toothed combs suitable for use on the coat length of some dogs and cats.

There have also been hair clippers which use attachment guide combs that have had vacuum inlets located above and outside of the V-shaped groove. An example of this is 1955 Sheley U.S. Pat. No. 2,748,472 which has a vacuum inlet located above and outside of where the V-shaped groove of the attachment guide comb would be located. It is of course not possible in this case for the vacuum inlet's opening to have an edge within the V-shaped groove of the attachment guide comb as the blades of the hair clipper occupy this space.

Several devices have addressed the need for combing through hair of different thicknesses. The 1967 Woodruff U.S. Pat. No. 3,308,500 taught an attachment with a fixed short comb in combination with a long comb which could be rotated into place. The 1971 Dove U.S. Pat. No. 3,626,546 taught a comb with adjustable length, a lever moving the teeth in and out of the housing. The 1972 Loscalzo U.S. Pat. No. 3,668,736 taught a vacuum comb with a plurality of different comb lengths, which could be snapped into position, while also addressing the narrow support base that the comb provides by adding a depth stop to the rear of the attachment, which could be changed with the comb. Though limited and complex, these designs would be effective on different hair thickness.

The attachment of a comb to a hair dryer has the advantage of improving the circulation of air through the hair. For example the 1972 Weber U.S. Pat. No. 3,696,818 teaches a hollow comb attached to a hair dryer by a flexible tube. The 1976 Tucker U.S. Pat. No. 3,937,231 teaches a comb attached directly to the mouth of a hair dryer. Still other examples are the 1985 Andis U.S. Pat. No. 4,538,362, and the 2004 Langley U.S. Pat. No. 6,775,922 which teach a plurality of attachments, some of which include a comb. Though complex and lacking comb length adjustment, all these devices have in common the advantage of having hot air blowing between the comb's teeth.

The attachment of a comb to a fluid dispenser has the advantage of increasing the fluid's circulation. The two types are those which use a container and those that use a faucet, such as a garden hose.

Devices drawing fluid from a container, typically a deformable container or squeeze bottle, are intended for use with shampoo and other hair treatments. The 1938 Wallenius U.S. Pat. No. 2,108,184, 1970 Iesersek U.S. Pat. No. 3,520,311, 1989 Morgan U.S. Pat. No. 4,813,439 and 2001 Burrowes U.S. Pat. No. 6,302,607 are all examples of this type.

Devices drawing fluid from a faucet such as a garden hose are typically contemplated for use in applying large quantities of water to the hair. The 1977 Houston U.S. Design patent D244,712 is an example of a simple device of this kind, intended for use in washing a dog. The 1997 Frank U.S. Pat. No. 5,649,502 teaches a combed device intended for use in washing pets.

Though all the above liquid dispensing combs are effective, each features a comb of a specific length and lacks length adjustment.

All the tools in the above background are useful and have enjoyed some degree of commercial success though only the hair clipper kit is universally recognized by and available to consumers.

It would be advantageous for the other five tools in the background above to employ hair clipper attachment guide combs for the five advantages of the guide comb described, as well as for their consumer familiarity, lack of complexity, and the economy of scale which makes them extremely economical.

The storage and organization the attachment guide combs within the hair clipper kit within a case or bag has always represented a problem. The attachment guide comb is very three dimensional and designed to slide along a surface. This has meant that the attachment guide combs easily shift and move around in a container and are not easily contained.

None of the attempts to organize and store attachment guide combs thus far have employed any means beyond those used in storing any other object. Typical solutions have been the McCambridge U.S. Design patents D545,500 and D548,888 which are essentially trays or caddies with the attachment guide combs resting within receptacles which must be appropriately dimensioned to accommodate each size comb. Without additional securing means the combs could easily fall out while being transported. These holders are also bulky and are not customizable, the number, type and location of attachment guide combs being fixed.

There has never been an attachment guide combs organizer that takes advantage of the attachment means which every attachment guide comb possesses.

SUMMARY OF THE INVENTION

The attachment guide comb conduit and the other diverse embodiments of the present invention all employ the same novel device: a form which functions as a dummy hair clipper head, or dummy blade, and thereby allows attachment guide combs to be attached anywhere, not just to an electric hair clippers stationary blade, and thereby allowing the attachment guide combs to be secured, organized and employed in new ways. The additional uses that the dummy blade makes possible creates means there are additional reasons, beyond the traditional hair clipper kit, for which the organization and storage of attachment guide combs is useful.

What is meant by a dummy hair clipper head, or dummy blade, is a form (as in a structure) which conforms to at least those dimensions of a hair clipper's head (typically its stationary blade) which are necessary for its compatibility with attachment guide combs. This form, not itself being a functional blade, as is the stationary blade of a hair clipper, has the function of providing a means of attachment for attachment guide combs of the type intended for electric hair clippers. Similarly a mannequin, or dummy of a human, conforms to the dimensions necessary for clothing to fit it properly.

The first and primary embodiment of the present invention is a conduit dummy blade which is hollow and open between the comb's teeth and attachable to a hose on top. This hose can then be attached to a vacuum's attachment hose, a hair dryer or faucet, whereby a vacuum comb, dryer comb, or liquid dispensing comb is created.

The second such embodiment is a means of organizing a set of attachment guide combs by attaching them to a series of interconnected compatible forms. This embodiment is elaborated on to include the interconnected blades being free standing, arranged along a contour, flexibly interconnected, connected to and within a container, and including compatible forms with flexibility and reduced structure. The applications for organizing attachment guide combs have been expanded by the many embodiments which have become possible as a result of the central inventive concept of employing a dummy blade.

The third embodiment is a conventional barber scissor fastened to a dummy clipper head to which the attachment guide combs can be attached. Once assembled, a scissor comb is created which is safe (the comb guarding the blade), and an effective means of trimming the hair to a uniform length with minimal noise or vibration.

The fourth embodiment is a razor comb having a razor held in a dummy clipper head with a handle. With the attachment of an attachment guide comb a razor comb is created.

The attachment guide combs typically have a V shaped groove as part of their attaching means. Both the dummy clipper heads for the razor comb and the scissor comb employ a novel method of engagement with the V shaped groove of the attachment guide comb which has several benefits and broader applications. Instead of engaging with the vertex of this groove they engage it along both the upper and lower portions so as not to extend fully into the groove.

Essentially, the central concept of the present invention is an adapter that functions to allow the attachment of attachment guide combs to a source of fluent material, such as a vacuum, hair blower, shampoo bottle or water faucet. It allows for the controlled transmission of fluent matter through the attachment guide comb. With the present invention the addition of a small piece of plastic to a standard hair clipper kit transforms it from a single tool into a well organized tool kit with a plurality of uses.

BRIEF DESCRIPTION OF THE DRAWINGS

These and other features, aspects and advantages of the present invention will become better understood with regard to the following description, appended claims, and accompanying drawings where:

FIG. 1 shows the outer surface of a prior art stationary blade of an electric hair clipper;

FIG. 2 shows a prior art hair clipper prior to insertion into an attachment guide comb;

FIG. 3 shows said hair clipper with its leading edge inserted into the attachment guide comb of FIG. 2, which is prior art;

FIG. 4 shows said hair clipper complete with guide comb attached and gripped in an operator's hand, which is prior art;

FIG. 5 shows the side of the hair clipper, which is prior art;

FIG. 6 shows the removed prior art stationary blade of the hair clipper head of FIG. 5;

FIG. 7 another perspective view of the removed prior art stationary blade of FIG. 5;

FIG. 8 is a perspective view of an attachment guide comb, which is prior art;

FIG. 9 is the attachment guide comb of FIG. 8 attached to the stationary blade of FIG. 7, which is prior art;

FIG. 10 is a perspective view of an attachment guide comb from above, which is prior art;

FIG. 11 is a side view of an attachment guide comb, a dotted line indicating the V-shaped groove 66, which is prior art;

FIG. 12 is a perspective view of a prior art attachment guide comb from below;

FIG. 13 is a perspective view of a prior art attachment guide comb from the rear;

FIG. 14 is a front view of an attachment guide comb, which is prior art;

FIG. 15 is a rear view of an attachment guide comb, which is prior art;

FIG. 16 is a top view of an attachment guide comb, which is prior art;

FIG. 17 is a bottom view of an attachment guide comb, which is prior art;

FIG. 18 is a side view of stationary blade 50 below a dummy blade 80 of the comb organizer 78 of the present invention;

FIG. 19 is a perspective view of the stationary blade 50 below a perspective view of the dummy blade 80 of the comb organizer 78 of the present invention;

FIG. 20 is a perspective view of the comb organizer 78 of the present invention with an attachment guide comb attached and a second guide comb of a smaller size unattached;

FIG. 21 is a perspective view of the comb organizer 78 from FIG. 20 as attached to the inside lid 86 of a partially shown box for a hair clipper kit 88, with a set of four attachment guide combs of different sizes attached to it;

FIG. 41 is a perspective view of an open back attachment guide comb from above, which is prior art;

FIG. 42 is a side view of an open back attachment guide comb, which is prior art FIG. 43 is the attachment guide comb of FIG. 41 attached to the stationary blade of FIG. 7, which is prior art;

FIG. 44 is a perspective view of an open back attachment guide comb from the rear, which is prior art;

DRAWINGS--Reference Numerals

Figure 1:
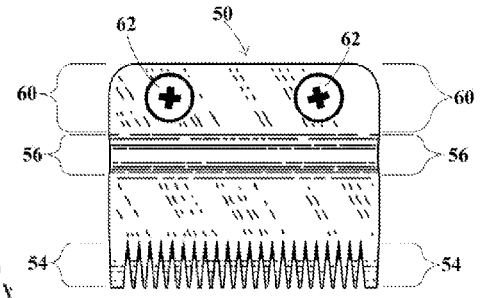
FIG 1 (PRIOR ART)
FIGS. 1-17, and 41-44 show prior art and do not represent the present invention.

| | | | |
|---|---|---|---|
| 50 | stationary blade | 52 | hair clipper |
| 54 | region of cutting teeth | 56 | central support region |
| 58 | reciprocating blade | 60 | rear region |
| 62 | two bolts | 64 | attachment guide comb |
| 66 | V-shaped groove | 67 | teeth |
| 68 | groove abutments | 70 | comb's back |
| 72 | side abutments | 74 | latch |
| 76 | protrusions | 78 | attachment guide comb organizer |
| 80 | dummy blade | 82 | thin rectangles |
| 84 | thick rectangle | 86 | lid |
| 88 | hair clipper kit box | 89 | spacer |
| 90 | scissor comb | 92 | barber's scissor |

-continued

| DRAWINGS--Reference Numerals | | | |
|---|---|---|---|
| 94 | counter sunk hole | 96 | screw |
| 98 | dummy blade B | 100 | upper edge |
| 102 | lower edge | 104 | groove |
| 106 | razor comb | 108 | handle |
| 110 | top plate | 112 | razor blade |
| 114 | base plate | 116 | cylindrical protrusions |
| 118 | apertures | 119 | threaded post |
| 120 | conduit dummy blade | 121 | restricted flow conduit dummy blade |
| 122 | rear edge | 124 | lead edge |
| 126 | holes | 128 | conical pipe |
| 130 | conduit socket | 132 | upright bottle |
| 134 | liquid dispensing comb | 136 | hose |
| 138 | faucet | 140 | cylindrical adapter |
| 142 | attachment vacuum hose | 144 | larger cylindrical adapter |
| 146 | hair dryer | | |
| 150 | open back attachment guide comb | 152 | backless parallel comb organizer |
| 154 | backless side by side comb organizer | 156 | angled base |
| 158 | mounting holes | 160 | pliable leading edge |
| 162 | recessed leading edge | 164 | engaging region |
| 166 | recessed region | 168 | snap on comb organizer |
| 170 | tab | 172 | slot |
| 174 | support structure | 176 | contoured storage container |
| 178 | contoured connecting structure | 180 | tracks |
| 182 | straight removable connecting structure | 184 | cord divider |
| 186 | cord storage compartment | 188 | cord |
| 190 | sloped rear edge | 192 | chain connecting structure |
| 194 | coupler | 196 | post |
| 198 | slotted support structure | 200 | fabric strap |
| 202 | comb plus cord organizer | 204 | cord clips |
| 206 | cord wrapping posts | 208 | modular comb organizer |
| 210 | modular form | 212 | extensions |
| 214 | fixed clipper mount | 216 | retractable dummy blade |
| 218 | retractable supports | 220 | snap |
| 222 | sponge | 224 | valve |
| 226 | bristles | | |

DETAILED DESCRIPTION OF THE INVENTION

The present invention is directed to the attachment of attachment guide combs of the type having a V-shaped groove to compatible forms, or dummy blades, other than the stationary blade of an electric hair clipper. A precise understanding of a typical electric hair clipper, attachment guide combs and their compatibility is important to understanding the embodiments of the present invention. FIGS. 1-17 depict a typical hair clipper and attachment guide comb, which are prior art.

Figure 5:
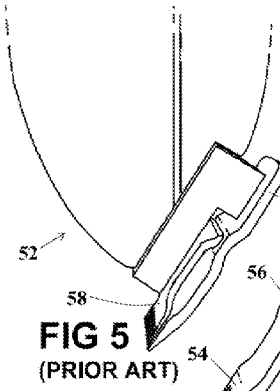
FIG 5 (PRIOR ART)
Figure 6:
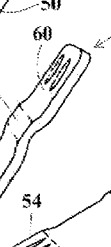
FIG 6 (PRIOR ART)
Figure 7:
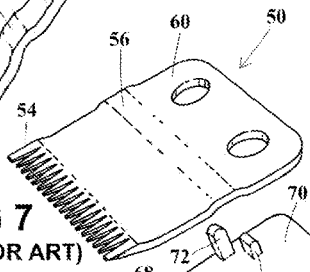
FIG 7 (PRIOR ART)
Figure 8:
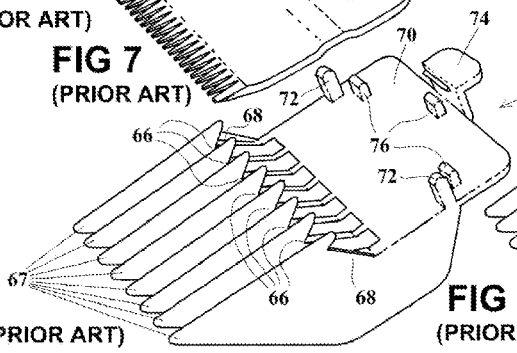
FIG 8 (PRIOR ART)

Referring to FIGS. 1, 5, 6, and 7 the stationary blade 50 of the hair clipper 52 is shown. FIG. 1 shows the outer surface of the stationary blade 50 which is entirely visible when attached to the hair clipper 52. FIG. 5 shows the stationary blade 50 as attached to the hair clipper 52 and FIGS. 6 and 7 show the stationary blade 50 removed from the clipper 52 with the inner surface shown.

The stationary blade 50 is 1.8 inches wide and 1.5 inches from front to back. The region of cutting teeth 54 at the front of the blade and a central support region 56 both curve toward the inner side of the blade. They are ground flat resulting in two raised flat plateaus 0.025 inches above the remainder of the stationary blade. It is with these two raised regions that the reciprocating blade 58 is in contact, as shown in FIG. 5.

The rear region 60 is flat and extends to 0.5 inches from the rear edge of the stationary blade 50, at which point the central support region 56 begins to curve toward the inner side. It is by this rear region 60 that the blade 50 is secured to the hair clipper 52 by two bolts 62.

The stationary blade 50 is made from 0.075 inch thick steel, making for a blade 50 with an overall thickness of 0.1 inches from the top of the raised regions 54 and 56 to the bottom, outer surface, of rear region 60. The leading edge along the region of cutting teeth 54 is tapered to 0.025 inches and consists of a series of teeth with flat tips.

Referring to FIGS. 8-17 the attachment guide comb 64 and its means of attachment to the blade 50 is now described. The attachment guide comb is secured to the blade 50 by contact with its four edges and the outer surface of the rear region 60 as follows.

Once attached, the attachment guide comb 64 is secured to the stationary blade 50 along its leading edge, the tapered edge of the region of cutting teeth 54, by a V shaped groove 66 in the series of comb teeth 67. The teeth 67 line up with the flat tips of the teeth which make up the leading edge along the region of cutting teeth 54.

The V shaped groove 66 terminates on each end in the groove abutments 68 which rise up to prevent the blade 50 from moving from side to side. The distance between the inside surfaces of the groove abutments 68 is 1.8 inches, corresponding to the width of the blade 50. The V shaped groove's position within the comb can be better understood by referring to FIG. 11 where a dotted line indicates the location of the V shaped Groove 66 in relation to the groove abutments 68. The V shaped groove 66 holds the tapered leading edge of the blade 50 with the upper surface of its raised region of cutting teeth 54 at 0.2 inches above the level of the comb's back 70.

At a distance of 0.5 inches from the rear edge of the comb back 70, two side abutments 72 abut the side edges of the blade 50. The distance between the side abutments 72 is also 1.8 inches corresponding to the width of the blade 50 and they prevent movement from side to side.

The rear edge of the blade 50 is secured by a latch 74. The distance between the latch 74 and the groove 66 is 1.5 inches corresponding to the length of blade 50 and preventing movement forward or backward.

A series of three protrusions 76 rise 0.1 inches and are located within the rear 0.5 inches of the comb back 70. The protrusions 76 abut the outer surface of the blade 50 along the flat rear region 60. In combination with the V shaped groove 66 and latch 74 these protrusions hold the comb's back 70 parallel to and 0.1 inches from the outer surface of the rear region 60 and 0.2 inches from the level of the upper surface of the region cutting teeth 54.

Figure 9:
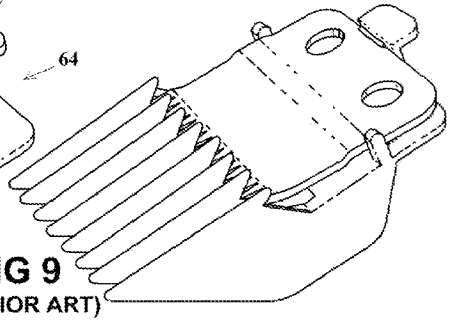
FIG 9 (PRIOR ART)
Figure 10:
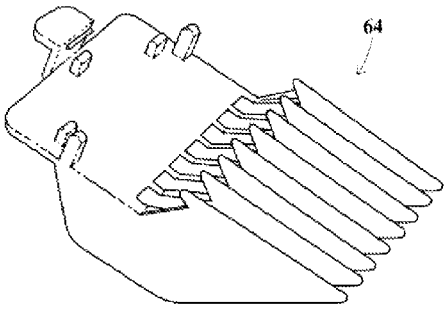
FIG 10 (PRIOR ART)
Figure 11:
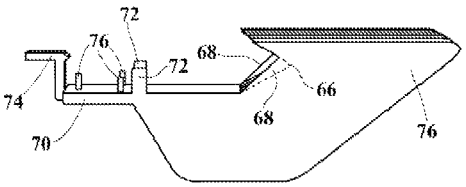
FIG 11 (PRIOR ART)
Figure 12:
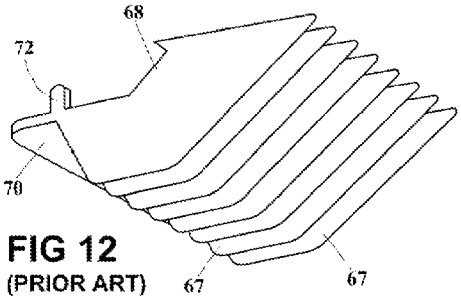
FIG 12 (PRIOR ART)
Figure 13:
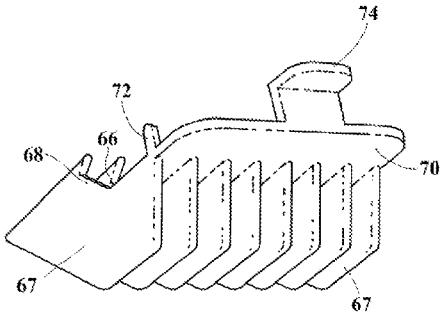
FIG 13 (PRIOR ART)
Figure 14:
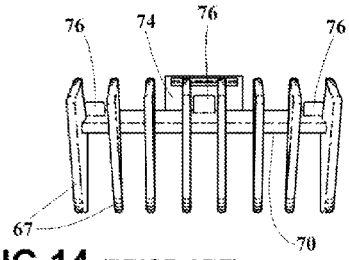
FIG 14 (PRIOR ART)
Figure 15:
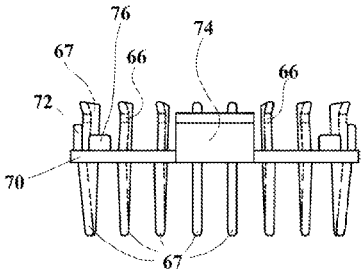
FIG 15 (PRIOR ART)
Figure 16:
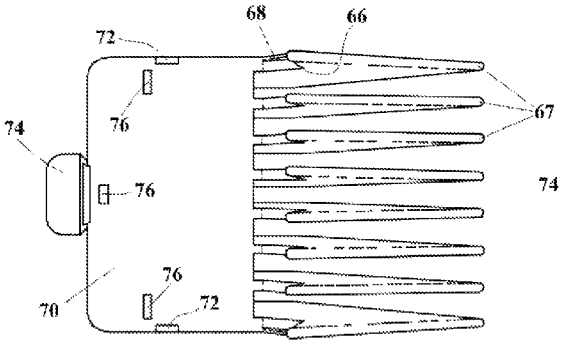
FIG 16 (PRIOR ART)
Figure 17:
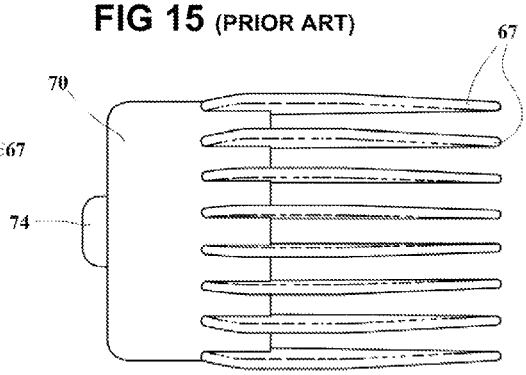
FIG 17 (PRIOR ART)

It is in this way that the attachment guide comb 64 is secured to the blade 50 as shown in FIG. 9. The areas of contact being the V shaped groove 66 along the leading edge, the groove abutments 68 and side abutments 72 along the sides, the latch 74 along the rear edge, and the protrusions 76 contacting the rear region 60. FIG. 9 shows the stationary blade 50 removed from the hair clipper 52 to allow the method of attachment to be more clearly visible. The stationary blade 50 is not normally removed from the hair clipper 52.

Figure 2:
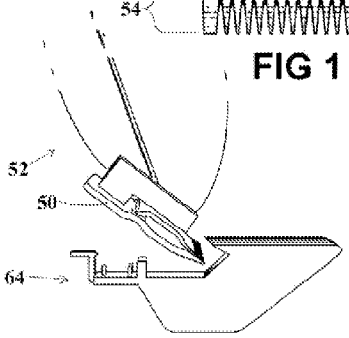
FIG 2 (PRIOR ART)
Figure 3:
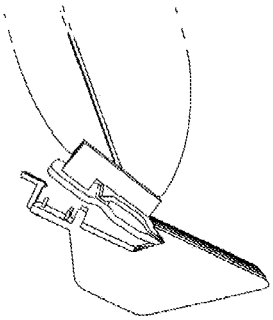
FIG 3 (PRIOR ART)
Figure 4:
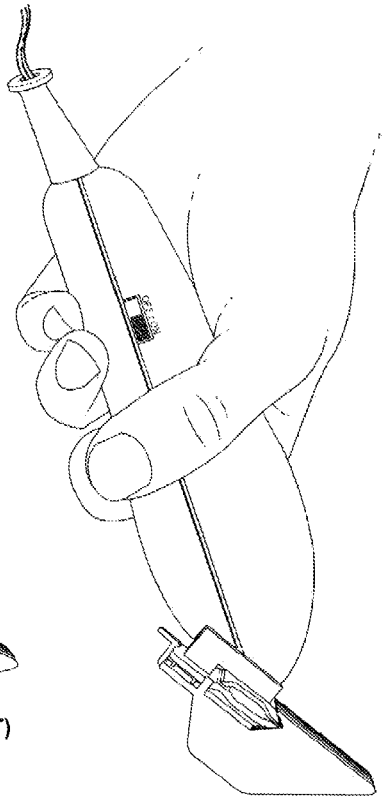
FIG 4 (PRIOR ART)

The procedure for the attachment of the comb 64 to the hair clipper 52 is shown in FIGS. 2-4. The leading edge is placed in the V-shaped groove 66 of the attachment guide comb 64 as shown in FIG. 3 and the comb is rotated into place where the latch 74 secures the comb at the rear edge of the blade 50. FIG. 4 shows hair clipper 52 with the attachment guide comb 64 attached as it would be used by the operator in cutting along a horizontal surface. To remove the comb 64, the latch 74 is pulled back and the attachment guide comb 64 is rotated away from the blade 50 and the leading edge of the blade 50 is removed from the V-shaped groove 66.

In use, as shown in FIG. 4, the comb's teeth 67 which are flexible to some degree (the attachment guide comb 64 is typically made of plastic) are supported by the comb back 70 and their engagement with the teeth of the stationary blade 50 along its leading edge at their points of contact at the vertex of the V-shaped groove 66. In use it is common for one or more of the teeth 67 to slip off the metal teeth of the blade 50 with which they are making contact at the vertex of the V-shaped groove 66 and to lose this support, bending to one side. This is because the teeth along the leading edge of the stationary blade 50 can only provide the series of narrow flat tips of its teeth for support with the series of gaps between them.

FIGS. 10-17 show the attachment guide comb 64 from all angles, depicting just one attachment guide comb size of the many sizes available in a kit. In use, as shown in FIG. 4, the comb back 70 is above and behind the V-shaped groove 66 and the leading edge of the blade 50. The comb back 70 is 1 inch from its rear edge to its leading edge leaving 0.5 inches open between its leading edge and the vertex of the V-shaped groove 66. This open area, most clearly shown in FIGS. 10 and 16, will be used by several embodiments of the present invention to be described later.

There are eight teeth 67 which rest on their longest side when in use as shown in FIG. 4. They hold the comb's back 70 and blade 50 at a thirty degree angle with the surface. Refer to the background of the invention for a list of the five advantages of the attachment guide comb 64 over a traditional flat comb.

The first embodiment of the invention is a comb organizer 78 and is shown in FIGS. 20 and 21. The organizer 78 consists of four adjacent dummy blades 80 shown separately in FIGS. 18 and 19.

FIGS. 18 and 19 show the dummy blade 80 above the stationary blade 50 to which it partially conforms. The dummy blade 80 includes a thin rectangle 82 which is 0.025 inches thick, and 1.8 inches by 0.75 inches, overlapping and bonded to a thick rectangle 84 which is 0.075 inches thick, and 1.8 inches by 1.2 inches. The rectangles overlap by 0.45 inches resulting in a combined rectangle 1.8 inches by 1.5 inches, which conforms to those dimensions of the blade 50.

The thin leading edge is 0.025 inches higher than the thick rear edge which also conforms to those dimensions of the stationary blade 50. The underside of the thick rectangle 84 is flat for more than 0.5 inches from the rear edge providing a suitable surface for the abutments 76, just as the rear region 60 does of the stationary blade 50 as described earlier.

With these dimensions the dummy blade 80, made of a suitably rigid material, would be compatible with the attachment guide comb 64. Additionally the leading edge of the dummy blade 80, being continuous, makes a superior engagement with the V-shaped groove 66 to that made by the stationary blade 50, as it obviates the possibility of the teeth 67 slipping and losing support as described above.

FIGS. 20 and 21 show the first embodiment of the present invention, the comb organizer 78, which includes four dummy blades 80 spaced 0.5 inches apart and connected by bridges 82 which connect the sides of the dummy blades 80 together. The bridges 82, which are the interconnection between the dummy hair clipper heads, are 0.4 inches wide and extend from the rear edge of the thin rectangle 82 to 0.35 inches from the its leading edge. The bridge 82 does not interfere with the attachment of the attachment guide comb 64 as the attachment guide comb 64 is open along the sides between the groove abutments 68 and the side abutments 72.

FIG. 20 shows the attachment guide comb 64 attached to one of the dummy blades 80. A second, smaller comb 84 which is not attached is also shown.

FIG. 21 shows four guide combs of different sizes attached to said comb organizer 78 which is attached to the lid 86 of a hair clipper kit box 88. The comb organizer 78 is attached to a spacer 89 which is in line with the bridges 82 and which holds the comb organizer 78 at 0.5 inches away from the lid. This is necessary so that the combs can be attached as the teeth 67 with the V shaped groove 66 extend around the leading edge of the blade, as does the latch 74 around the rear edge.

The comb organizer 78 could most easily be made in one piece integral with the lid of the box and its description here in parts is for clarity and to allow a precise understanding of the dimensions. Attached to the lid 86 of the clipper kit box 88, said organizer would provide a means of storing and organizing combs as quick and effective as their attachment to the stationary blade 50.

The support that this embodiment of the dummy blade 80 would provide to the attachment guide comb 64 would be superior to that which is provided by the hair clipper's actual stationary blade. For some purposes, such as simple storage and organization, this is not necessary and variations on the dummy blade 80 would have some advantages. These variations will be shown and described later.

FIGS. 22-26 show the second embodiment of the invention which is the scissor comb 90. The scissor comb 90 includes a barber's scissor 92 with a single counter-sunk hole 94 drilled into one blade 1.5 inches from the tip. A screw 96 secures the scissor 92 to a dummy blade B 98. The dummy blade B 98 allows the attachment of the attachment guide comb 64. The scissor comb 90 can then be pulled through hair and employed cutting the hair to a uniform thickness.

Figure 22:
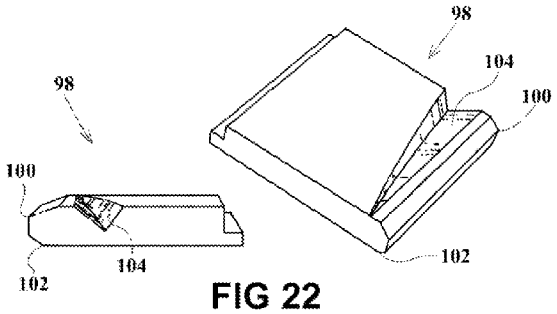
FIG. 22 is a side and perspective view of the dummy blade B 98 of the scissor comb 90 of the present invention.
Figure 23:
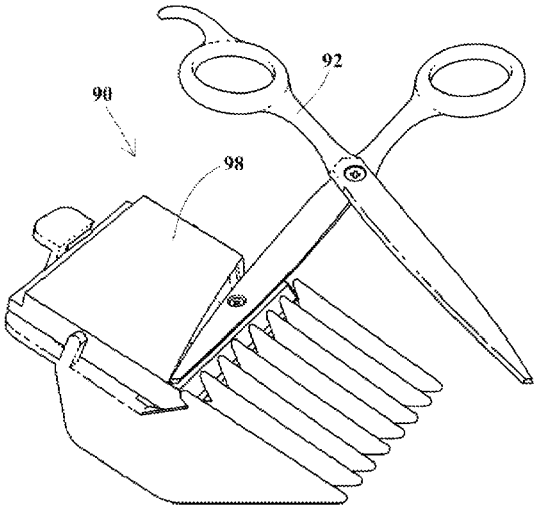
FIG. 23 is a perspective view of the scissor comb 90 of the present invention fully assembled with scissor and attachment guide comb attached.
Figure 24:
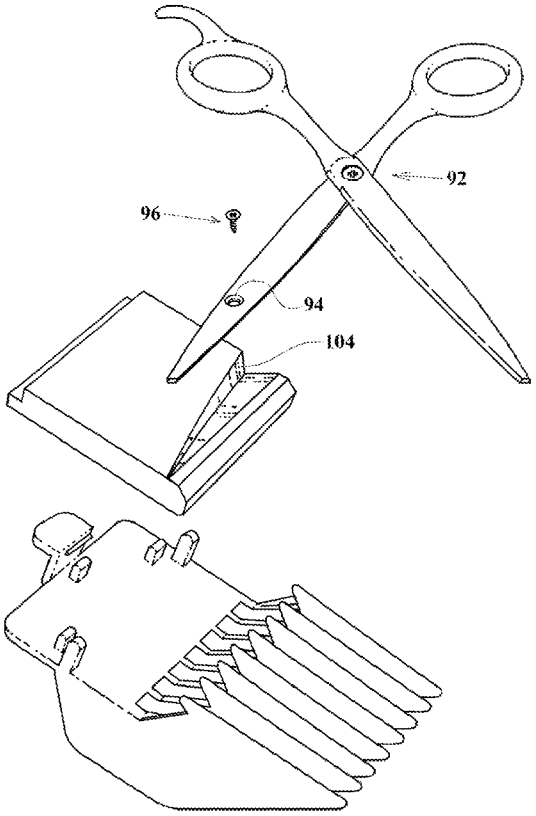
FIG. 24 is an exploded perspective view of FIG. 23.

The dummy blade B 98 is shown from two angles in FIG. 22, from the side and in perspective. It is 1.8 inches wide, as is the stationary blade 50. It is 1.4 inches from its beveled leading edge to its rear edge, where the real stationary blade 50 is 1.5 inches. This shorter length is due to the novel means by which dummy blade B 98 engages the V shaped groove 66 which is indicated by dotted lines in FIG. 25. Rather than contacting the groove 66 at its vertex, as the stationary blade 50 does, it instead makes dual contact, an upper contact along its upper edge 100 with the upper portion of the groove and a lower contact along its lower edge 102 with the lower portion as shown. As both these edges are continuous, this makes a superior engagement with the V shaped groove 66 to that made by the real stationary blade 50, as it obviates the possibility of the teeth 67 slipping and losing support as described above.

In the case of the scissor comb 92, the primary reason dummy blade B 98 contacts the V shaped groove at edges 100 and 102 is precisely so that it can be shorter than the blade 50 and not extend as far forward into the V shaped groove 66. This is because it is important that the cutting blade of the scissor 92 be positioned ahead of the dummy blade B 98 as in the form shown said dummy blade B 98 represents an obstruction to the flow of hair. This novel means of dual engagement of the V shaped groove 66 is part of the razor comb of the present invention as well and has broad applications.

The dummy blade B 98 could alternatively engage the vertex of the V shaped groove with a leading edge consisting of a series of long teeth, as the stationary blade 50 does though with much longer teeth (this alternate form is considered obvious within the present invention and is not shown).

The dummy blade B 98 is 0.25 inches thick. The rear edge is reduced to 0.075 inches as shown, to be compatible with the comb's latch 74.

Figure 25:
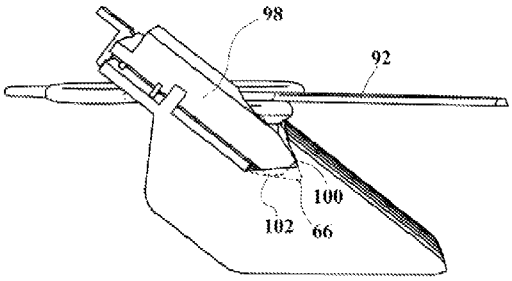
FIG. 25 is a side view of FIG. 23 with dotted lines indicating the contact of the dummy blade B 98 with the V-shaped groove 66.
Figure 26:
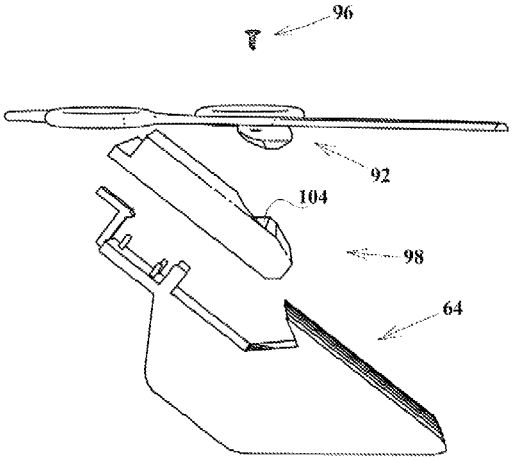
FIG. 26 is an exploded view of FIG. 25.
Figure 27:
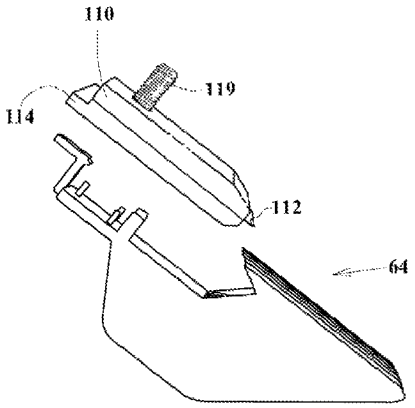
FIG. 27 is the razor comb 106 of the present invention without a handle and above the guide comb.

A groove 104 is carved into the upper surface of dummy blade B 98 at a 30 degree angle. In use the attachment guide comb 64 hold the comb's back 70 and blade 50 at a 30 degree angle with the surface. This groove 104 is carved at 30 degrees so that the scissor 92 will be parallel to the surface. The groove 104 is also suitably above the upper edge 100 so that when attached the scissor 92 will have its cutting edge above the tops of the comb's teeth 67, as shown in FIG. 25.

The groove 104 is carved in a curve congruent to the back edge of the blade of the scissor 92. Once secured by the screw 96 the blade of the scissor 92 will be firmly connected to and held in place against the dummy head B 98.

Once assembled, the scissor comb 90 could be pulled through the hair and a series of cuts made with the scissor to achieve an overall cut of uniform length. Additionally, the attachment guide comb 64 and dummy head B 98 would effectively guard the blade and make the scissor comb 90 much safer to use than a scissor alone.

Figure 28:
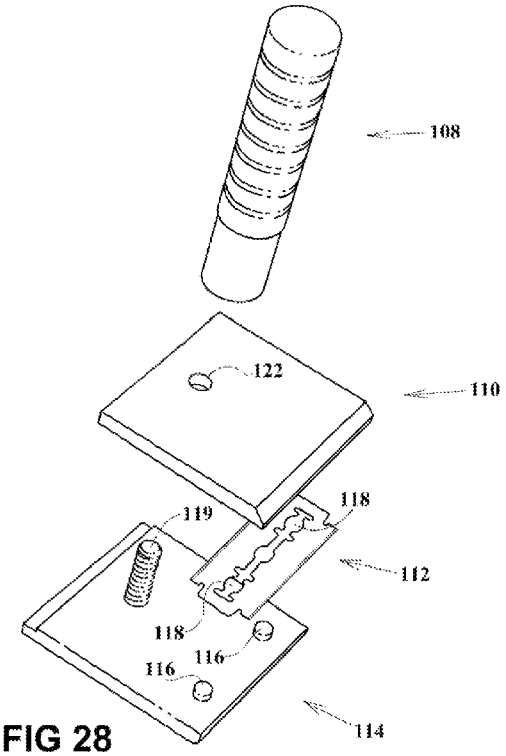
FIG. 28 is an exploded perspective view of the razor comb 106 of the present invention without a guide comb.
Figure 29:
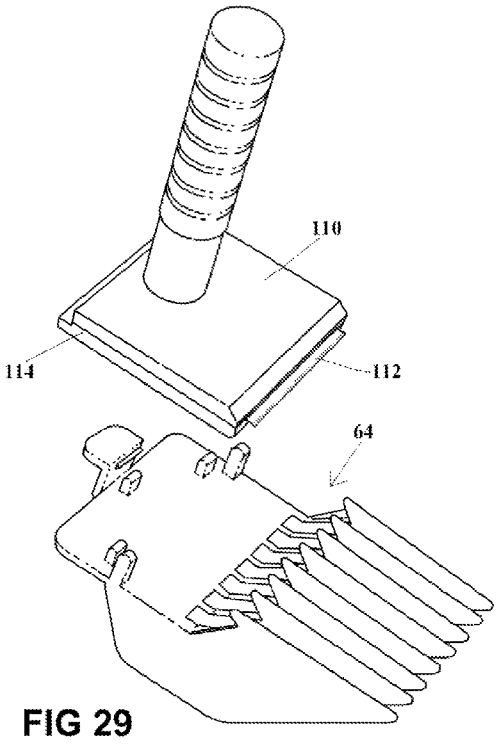
FIG. 29 is a perspective view of FIG. 28 fully assembled above an attachment guide comb.
Figure 30:
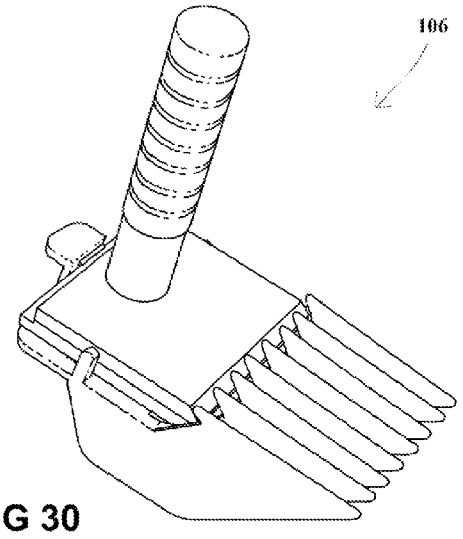
FIG. 30 shows FIG. 29 fully assembled, being the razor comb 106.
Figure 31:
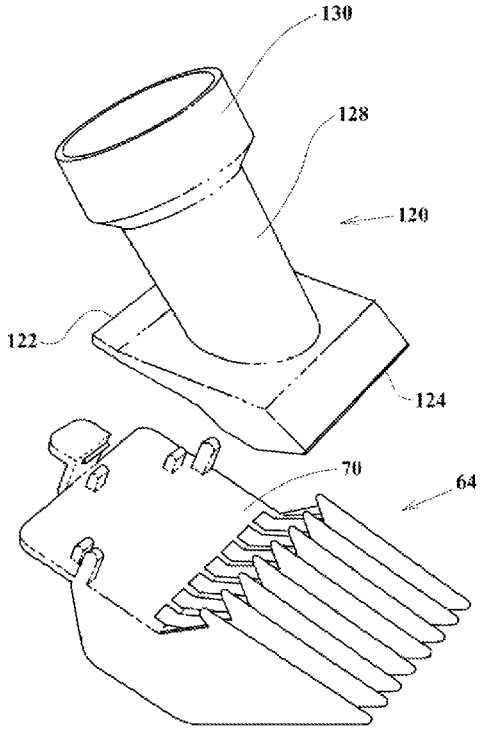
FIG. 31 is a perspective view of the conduit dummy blade 120 of the present invention above the attachment guide comb 64.
Figure 32:
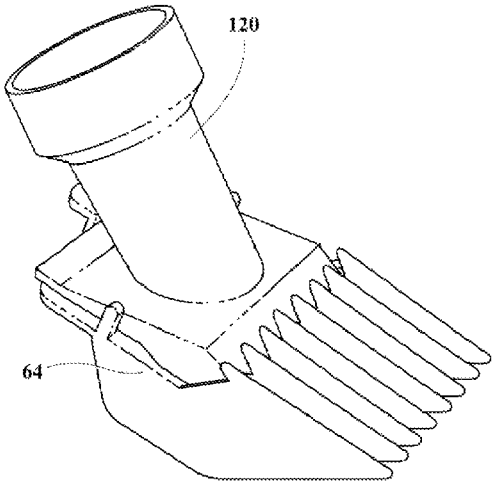
FIG. 32 is a perspective view of the attachment guide comb 64 attached to the conduit dummy blade 120 of FIG. 31.

The third embodiment of the present invention, the razor comb 106 is shown in FIGS. 27-30. Referring to FIG. 28 which is an exploded view of the four pieces of the razor comb 106 (other than the attachment guide comb 64), the razor comb 106 consists of a handle 108, a top plate 110, a razor blade 112, and a base plate 114 which when fully assembled connect with the attachment guide comb 64.

The razor 112 is held in position on the base plate 114 by two cylindrical protrusions 116 which are inserted into apertures 118 of said razor 112. The top plate 110 is then placed over the base plate 114 passing the threaded post 119 of the base plate 114 through the hole 122 of the top plate 110 and finally inserting the cylindrical protrusions 116 into corresponding cylindrical depressions (not shown) in the underside of the top plate 110. The handle 108, which has a threaded socket (not shown), is then threaded onto the post 119 and the four pieces are thereby secured together.

The top plate 110 and base plate 114 together constitute a dummy blade with dimensions identical to dummy blade B 98 with the exception of the presence of the threaded post 120 and the omission of the groove 104. The dummy blade of plates 110 and 114 engages the V shaped groove 66 in the same novel fashion as dummy blade B 98 (refer to FIG. 25). The purpose of doing so in this embodiment is to leave the remainder of the V shaped groove 66 open for the operative member, which is the razor blade 112, to occupy. As stated above, this novel engagement is superior to the engagement made by the real stationary blade 50 as the teeth 67 are in contact with a continuous surface. It should also be noted that this engagement is superior as it places the cutting edge ahead of the engaging structure so that the cutting edge is more fully exposed.

While the scissor comb 90 cuts entirely above the V shaped groove 66, the razor blade 112 of the razor comb 106 is near the vertex of the V shaped groove 66, in approximately the same location the cutting teeth of the clipper 52 would be.

As stated with the scissor comb 90 an alternate form (considered obvious within the present invention and lacking several advantages stated above) for the dummy clipper head of the razor comb 106 would be long teeth which would engage the vertex of the V shaped groove 66 as the blade 50 does, leaving the razor 112 exposed between said teeth (as the Custer U.S. Pat. No. 4,663,841 does).

Once assembled, the razor comb 106 could be pulled through the hair and the razor 112 would be both effectively guarded and the length of hair cut reliably, regulated by the attachment guide comb 64.

The embodiment focused on in this continuation in part application is the embodiments of the present invention which involve the use of a conduit dummy blade 120, shown in FIGS. 31-36 and 65-72. The conduit dummy blade 120 is designed to allow the use of a guide comb with a fluent material flowing through the opening between the teeth 67. This opening can be as wide as the attachment guide comb 64 and begins at the leading edge of the comb back 70 up through the V shaped groove 66, as described earlier and is most clearly shown in FIGS. 10 and 16.

The conduit dummy blade 120 is hollow with a length from the rear edge 122 to its leading edge 124 of 1.5 inches and a width of 1.8 inches. The leading edge 124 is 0.025 inches above the plane of the upper surface of the rear edge 122. The dummy rear edge 122 is 0.075 inches thick for compatibility with the latch 74 and the underside is flat for more than 0.5 inches from the dummy rear edge 122 providing a suitable surface for abutment by the protrusions 76. With these dimensions the conduit dummy blade 120 corresponds to the stationary blade 50 and is compatible with the attachment guide comb 64. Additionally, as the leading edge 124 is continuous, a superior engagement with the V shaped groove 66 is made to the engagement made by the stationary blade 50 for the reasons discussed previously.

The front of the dummy conduit blade 120 is wedge shaped as shown in FIGS. 31-36, and with the leading edge 124 in contact with the vertex of the V shaped groove 66 this wedge fills said groove. The fact that the apertures through which fluent material is transmitted is not open outside of fv Referring to FIGS. 31-36 the underside of the conduit dummy blade 120 is parallel to and 0.1 inches from the comb back 70, from the rear edge 122 to 0.7 inches from the rear edge 122. The underside of the dummy conduit blade 120 then slopes down toward the comb back to converge with the comb back 70 at its leading edge, where the opening between the teeth 67 begins. The side walls of the conduit dummy blade 120 continue with their lower edges flush with the outermost teeth 67 until the leading edge is formed as described above. The opening located along the underside of said conduit dummy blade is thereby focused down through the openings between the teeth 67 and not out the sides or back of the attachment guide comb 64.

Figure 33:
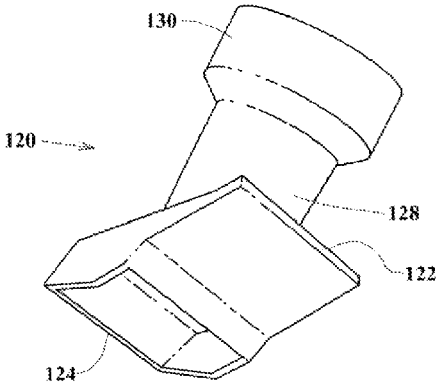
FIG. 33 is a perspective view from the rear and below of the conduit dummy blade 120 of the present invention.
Figure 34:
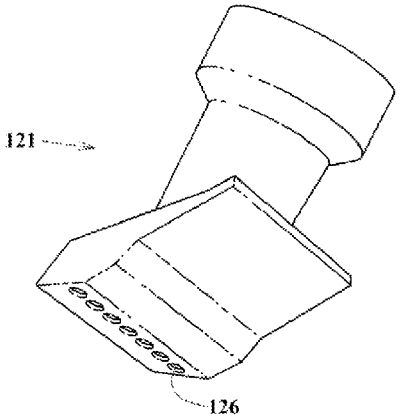
FIG. 34 is a perspective view from the rear and below of the restricted flow conduit dummy blade 121 of the present invention.

FIG. 33 shows that the conduit dummy blade 120 is open on the underside from where it would meet the leading edge of the comb back 70 on up to the leading edge 124. FIG. 34 shows that the restricted conduit dummy blade 121 is closed except for 7 holes 126 along the lower incline of the wedge, which align with the lower portion of the V shaped groove 66 and the spaces between the eight teeth 67.

The upper surface of the conduit dummy blade 120 slopes up from near the rear edge 122 until it meets the wedge of the front of dummy conduit blade 120. Out of this inclined surface on the upper side of the conduit dummy blade 120 conical pipe 128 rises and expands to suitably terminate in conduit socket 130 threaded to accommodate a standard 1 inch lip of a plastic bottle or garden hose.

Figures 35, 36, 37, 38, 39:
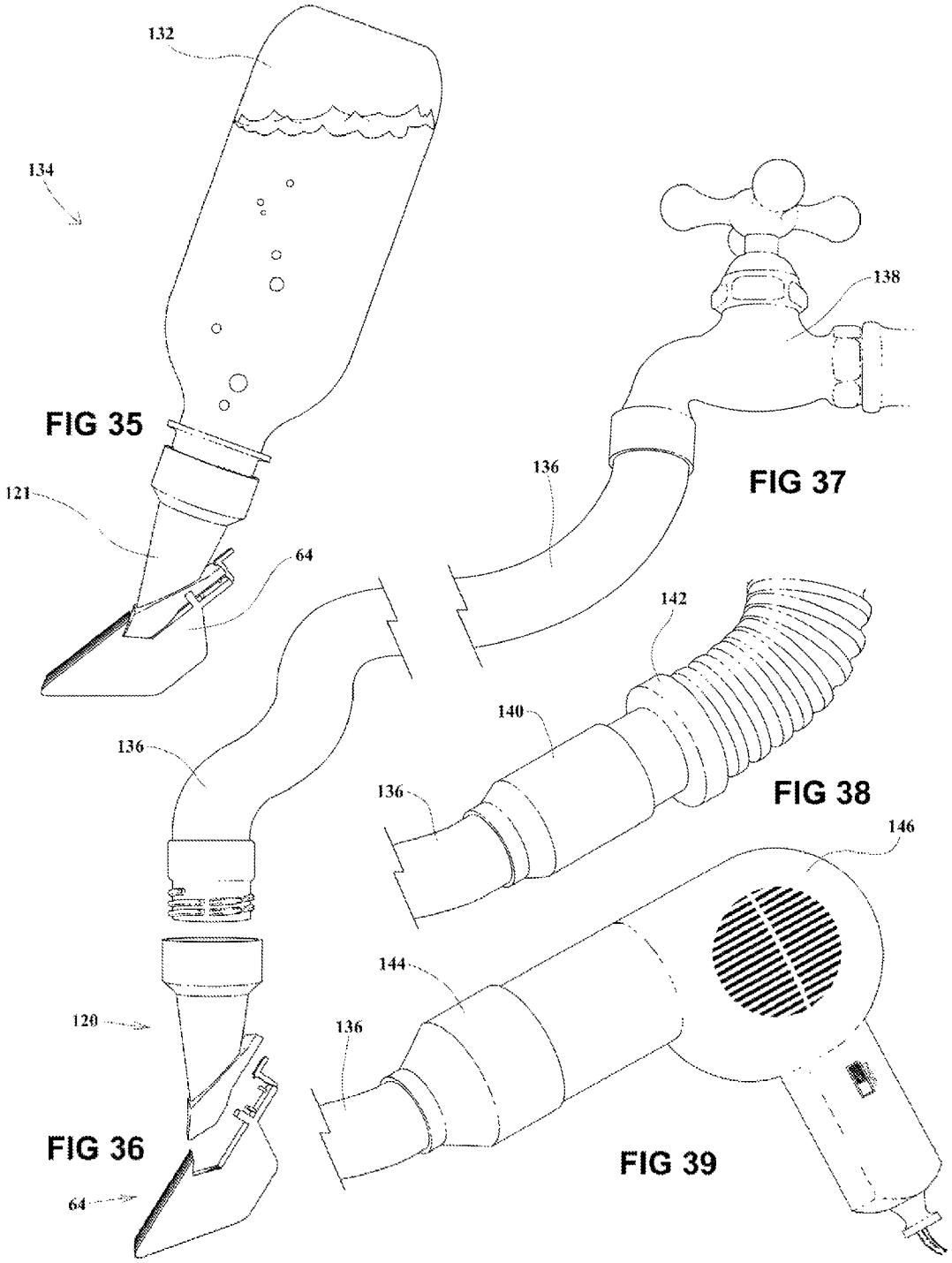
FIG. 35 is a side view of the liquid dispensing comb 134 of the present invention fully assembled with a bottle containing liquid attached.
FIG. 36 is an exploded perspective side view of the vacuum comb, the dryer comb and the liquid dispensing comb of the present invention from the attachment guide comb end of the hose.
FIG. 37 shows the faucet end of the liquid dispensing comb of the present invention with a hose attached to a faucet.
FIG. 38 shows the vacuum end of the hose for the vacuum comb of the present invention with the hose 136 attached to an attachment vacuum hose 142.
FIG. 39 is the dryer end of the hose 136 for the dryer comb of the present invention with a hose 136 attached to a hair dryer 146.

The fourth embodiment of the present invention is the connection of a plastic bottle 132 to the restricted flow conduit dummy blade 121 as shown in FIG. 35 to create the liquid dispensing comb 134. The restricted conduit dummy blade 121 is screwed onto an upright bottle 132 filled with fluid. The attachment guide comb 64 is then attached and the three items together constitute a liquid dispensing comb 134. Once inverted the liquid flows through the hollow restricted conduit blade 121 and out the holes 126 and between the teeth 67 and onto the hair being combed through. In this way shampoo and other hair treatments can be applied to hair as it is simultaneously being combed.

Referring to FIGS. 34, 36 and 37 the second variation on the fourth embodiment of the present invention is the connection of a hose 136 to the restricted conduit dummy blade 121, the other end of the hose being attached to a faucet 138. In this way water would flow out the holes 126 as described above. Use of pressurized water would be effective as well as the comb would not be knocked off by the pressure since the holes 126 are aligned with the openings between the teeth 67.

The fifth embodiment of the present invention involves connecting a vacuum source to create a vacuum comb. Conduit Dummy blade 120 with its large opening would have an attachment guide comb 64 connected to it and a hose 136 connected as described above. The other end of the hose 136 would connect to a cylindrical adapter 140 with an inside diameter appropriate for connection with the attachment vacuum hose 142 of a household vacuum. In this way, once connected the vacuum comb could be combed through the hair as the vacuum removed dislodged debris.

The sixth embodiment of the present invention is a third application of the conduit dummy blade 120, the dryer comb. The device is assembled as described above with the exception that the cylindrical adapter 140 would be replaced by a larger cylindrical adapter 144 suitable for connection to the barrel of a hair dryer 146. In this way, once connected a dryer comb could be combed through the hair as hot air blew between the teeth 67.

Please refer to the last portion of this detailed description for the further elaboration on the conduit dummy blade 120 and restricted conduit dummy blade 121

In each of the diverse embodiments employing the dummy hair clipper head taught here only a few of the many forms that the dummy hair clipper head could take are shown. These forms have been selected for the clarity with which they illustrate the nature of the present invention It is likely that their form would change in mass production, though they would still represent the principle of the present invention.

Like the elongated teeth on a dummy head mentioned in the description of the scissor comb 90 and the razor comb 106, there are many variations which are within the scope of the present invention. The precise dimensions given for both the stationary blade 50 and the attachment guide comb 64 and their means of engagement are to illustrate a typical example. Variations in these dimensions and the method of attachment should be construed as being within the scope of this patent.

The novel dual engagement of the V-shaped groove 66 which is part of the scissor comb 90 and razor comb 106 should not be construed as being limited to these two devices. This novel method of connection to a guide comb has broad application to both the dummy hair clipper heads of the present invention as well as to the hair clipper itself.

Figure 40:
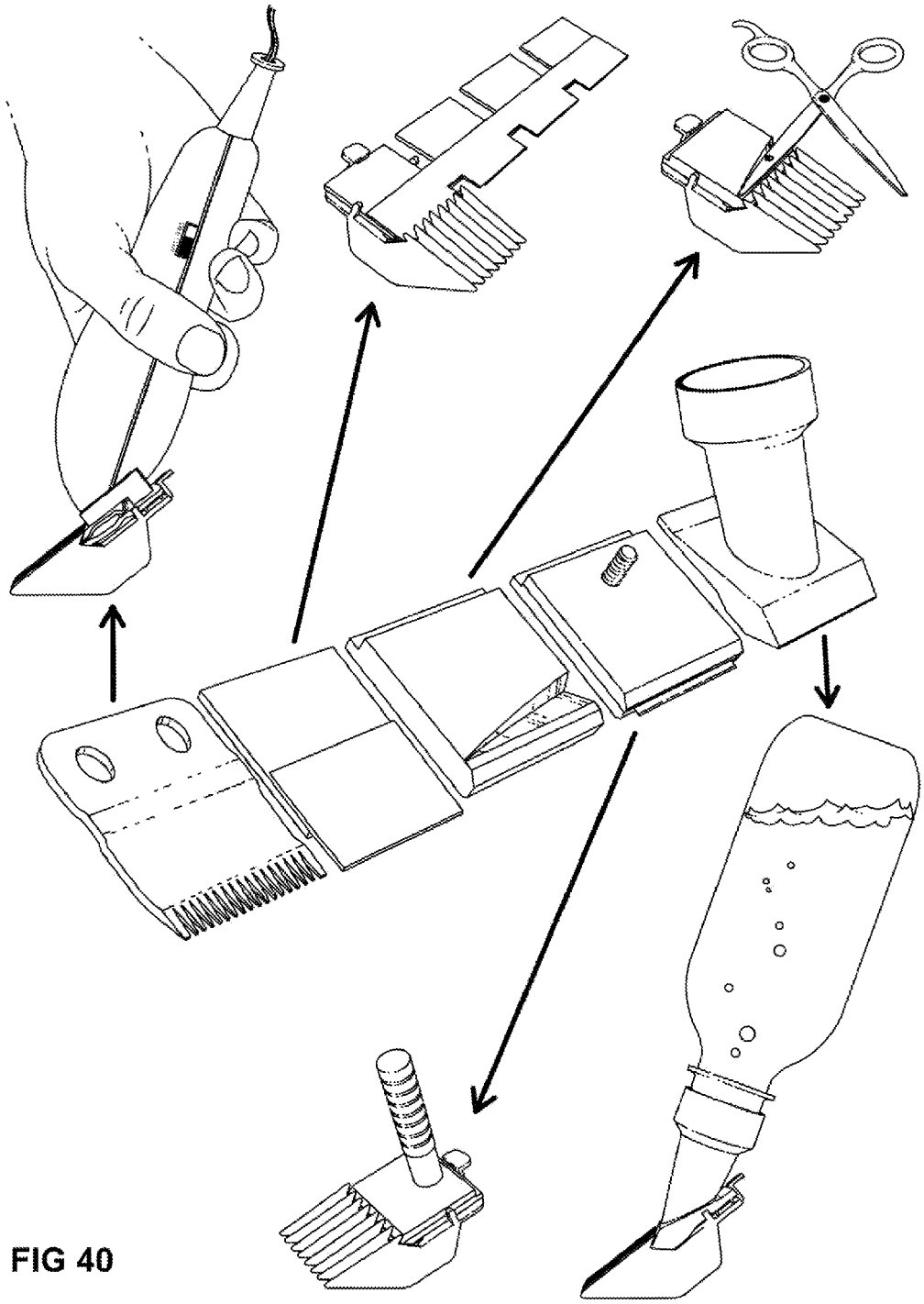
FIG. 40 is a perspective view of the stationary blade and the variations on dummy blades side by side with arrows leading to their varied applications.
Figure 41:
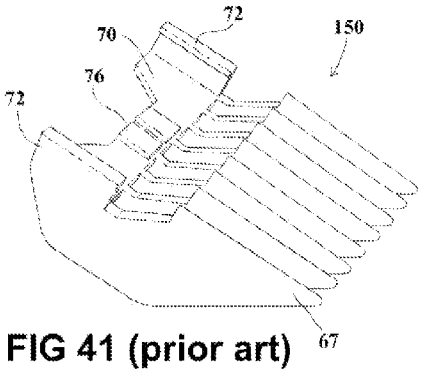
FIG 41 (prior art)
Figure 42:
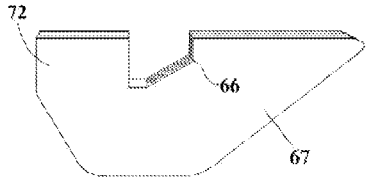
FIG 42 (prior art)

The several variations on the unifying inventive principle of the dummy hair clipper head, as they have been taught here, are shown together in FIG. 40. FIG. 40 illustrates the variations on the forms, which are either the stationary blade or the various dummy blades, side by side to illustrate their common dimensions. The diverse means by which the attachment guide combs can then be employed are illustrated at the end of each arrow.

The comb organizer embodiment is elaborated on below. It is first important to understand the variation on the attachment guide comb which does not have a rear latch 74. It is described here as an open back attachment guide comb 150, which is prior art well known in the art, and it makes an additional variations on the comb organizer 78 possible.

Figure 43:
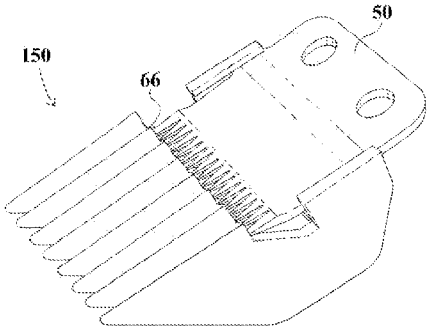
FIG 43 (prior art)
Figure 44:
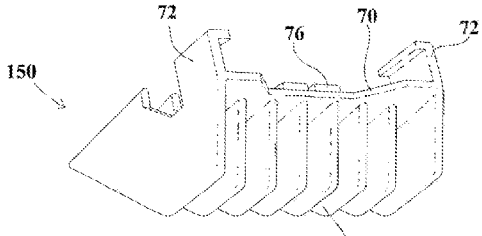
FIG 44 (prior art)

Referring to FIGS. 41-44 the prior art of the open back attachment guide comb 150 is shown with the side abutments 72, which are enlarged to make a larger contacting surface, and include a surface to contact the upper/inner surface of the stationary blade 50 or dummy blade 80. As shown in FIG. 43 the stationary blade 50 is inserted into the V-shaped groove 66 while the side abutments 72 hold the stationary blade in place with a press fit (and sometimes a snap into the central support region 56). The enlarged side abutments 72 also serve to ensure the proper alignment into the V-shaped groove 66 making a second pair of groove abutments 68 optional. FIG. 43 shows that the rear portion of the stationary blade 50 is open and unobstructed by the open back attachment guide comb 150. The V-shaped groove 66 of this type of open back attachment guide comb 150 is sometimes obtuse as shown.

All of the variations on the present invention taught here would be compatible with the open back attachment guide comb 150, though some would require slight modifications from what has been shown in the drawings. The conduit dummy blade 120 would simply need to include ridged or narrowed sides to make a solid engaging contact with the side abutments 72 as shown on the open back attachment guide comb 150, and the dummy blades similar to what is shown with dummy blade B 98 could simply be thinner or tapper at the sides. The open back attachment guide comb 150 offers additional possibilities and more versatility for the comb organizer 78.

Figure 45:
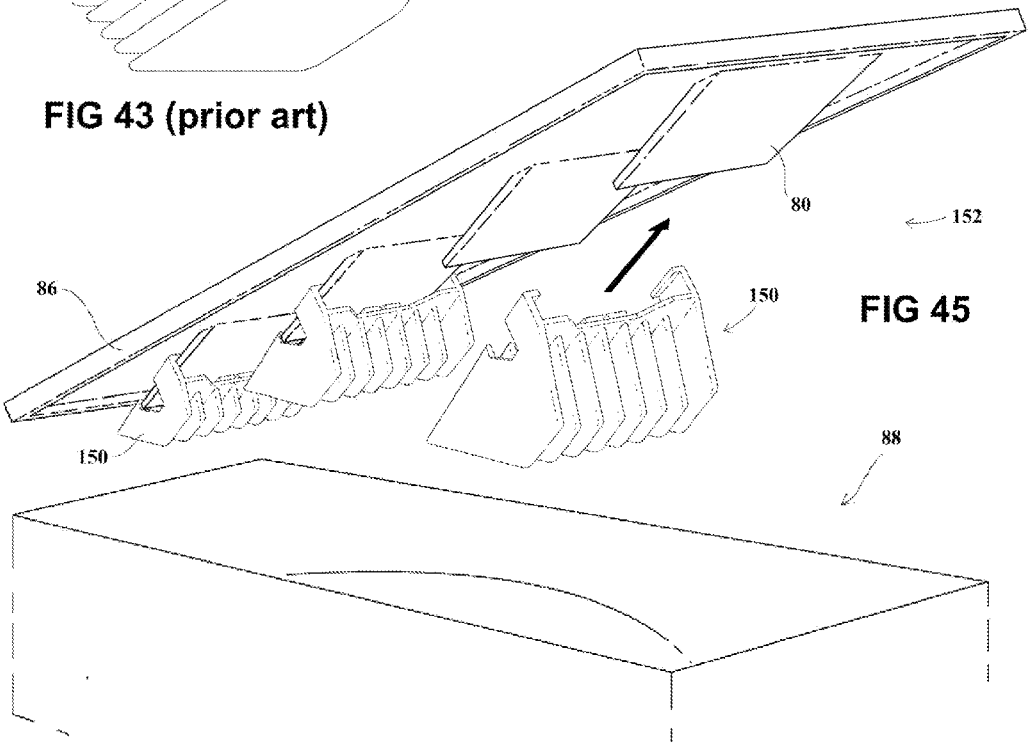
FIG. 45 is a perspective view of the backless parallel comb organizer 152 of the present invention with open back attachment guide combs 150 of various sizes attached to dummy blades 80 which are connected to the lid of a hair clipper kit box 88.

This open back style of attachment guide comb allows for the backless parallel comb organizer 152 shown in FIG. 45. The backless parallel comb organizer 152 is shown as part of a box lid 86 for a hair clipper kit box 88, and it is similar to the comb organizer 78 of FIG. 21, however the dummy blade 80 in this case has its back edge fused to the supporting structure of the lid 86 and is not supported by the spacer 89. In using the backless parallel comb organizer 152 the user would simply press the backless attachment guide combs 150 down onto the dummy blades 80 to secure them in place. Three open back attachment guide combs 150 of various sizes are shown in FIG. 45 with two already mounted on dummy blades 80 and one removed with an arrow indicating the method of sliding it onto the dummy blade 80.

Figure 46:
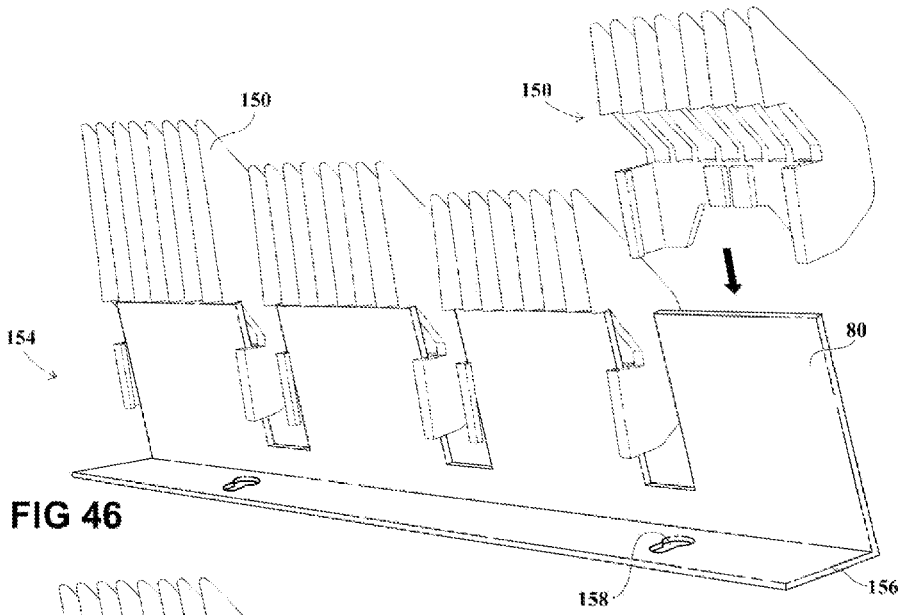
FIG. 46 is a perspective view of the backless side by side comb organizer 154 of the present invention with open back attachment guide combs 150 of various sizes attached to dummy blades 80 which are connected to an angled base 156 with mounting holes 158.

Another comb organizer which could be utilized by the backless attachment guide comb 150 is the backless side by side comb organizer 154 shown in FIG. 46. This backless side by side comb organizer 154 has the combs arranged side by side, rather than front to back as with the backless parallel comb organizer 152. It is shown with an angled base 156 to allow it to be free standing on a table top, and with mounting holes 158 which would allow it to be mounted on a wall. Four open back attachment guide combs 150 or various sizes are shown with three already mounted on dummy blades 80 and one removed with an arrow indicating the method of sliding it onto the dummy blade 80.

For simply storing and organizing any attachment guide comb the structure of the comb support can also change. In organizing the combs it is not necessary for all of the teeth to be supported with the same rigidity that is important while they are being employed. While being stored the attachment guide comb is not likely to be under stress, and if it is and teeth are bent to the side, it is acceptable.

Figure 48:
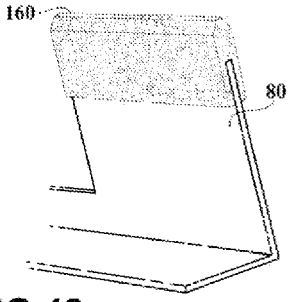
FIG. 48 is a perspective view of a dummy blade 80 with a pliable leading edge 160.

Referring to FIG. 48 the pliable leading edge 160 is composed of a flexible material such as rubber, silicone or sponge. This pliable leading edge 160 would allow for a less precise engagement when the attachment guide comb 64, or open back attachment guide comb 150, is placed upon it. This would allow for faster attachment and removal while the pliable leading edge 160 could still be sufficiently resilient to hold the combs in place against the forces of gravity and inertia encountered while being stored and transported.

Figure 47:
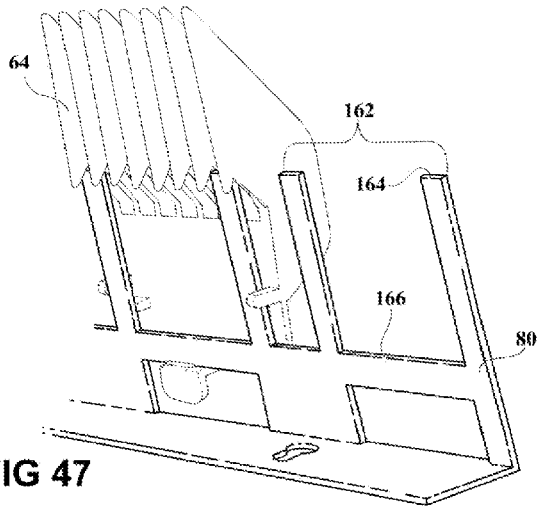
FIG. 47 is a perspective view of two side by side dummy blades 80 with recessed leading edges 162.

For the same reason it is not necessary for the leading edge to be rigid for the purposes of storage it is not necessary for the leading edge to support every tooth 67. In order to hold the attachment guide comb 64 in place it is preferable that contact be made with the side abutments 72 and at least partial contact be made with the V-shaped groove 66. Referring to FIG. 47 a recessed leading edge 162 is shown with engaging regions 164, and recessed region 166. This recessed leading edge 162 would prevent the attachment guide comb 64 from moving in any direction. While it would not support the inner teeth 67 this is not important for the purposes of comb storage. This type of leading edge would allow for reduced material use in manufacture and for a less obstructive and more open structure while the combs are not attached.

Figure 49:
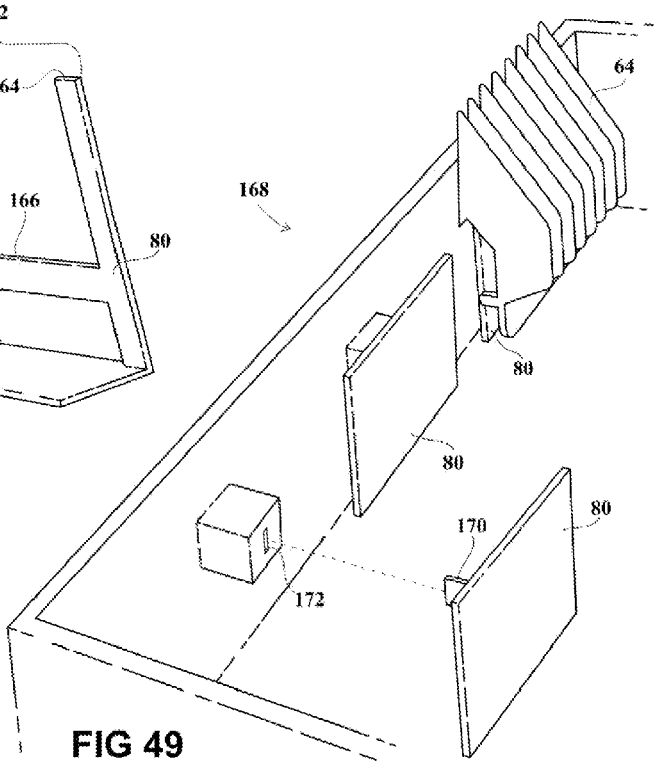
FIG. 49 is a perspective view of the snap on comb organizer 168 of the present invention showing an attachment guide comb 64 attached to a dummy blade 80 connected to a support structure 174 and a removed dummy blade 80 with tab 170 which is to be inserted into slot 172.

It would also be useful to have a modular system for organizing the attachment guide combs in which the number and location of dummy blades 80 is adjustable, and thereby the locations at which the attachment guide combs 64 can be stored would be adjustable. FIG. 49 shows the snap on comb organizer 168 in which the dummy blades 80 include tabs 170 which engage slots 172 in order to mount the dummy blade 80 on a support structure 174. This would allow for as much versatility in the placement of the dummy blades 80 as there were slots 172, as well as for the removal of some of or all of the dummy blades 80. It may also be advantageous in the removal of a stored attachment guide comb 64 to remove the dummy blade 80 to which it is attached first, by pulling the tap 170 from the slot 172, and only after the dummy blade 80 with attachment guide comb 64 are in hand remove the attachment guide comb 64 from the dummy blade 80.

Figure 50:
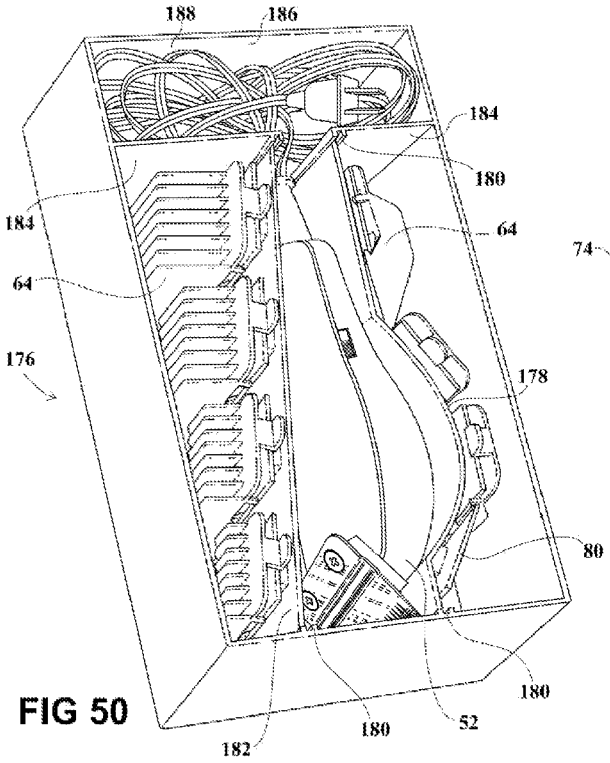
FIG. 50 is a perspective view of the contoured storage container 176 of the present invention with a contoured connecting structure 178 and straight removable connecting structure 182 both inserted into tracks 180 and securing the hair clipper's body 52 with cord divider 184 containing the cord 188.

The location of the attachment guide combs being stored is also controlled by the structure of the connections between the forms to which they attach. FIG. 50 shows a hair clipper kit which has been organized into a contoured storage container 176 which includes a contoured connecting structure 178 which is curved to follow the curving back of the hair clipper's body 52. This serves to both maximize the storage capacity of the container and to secure the hair clipper 52 and prevent it from sliding around the container. The contoured connecting structure 178 is removably inserted into the container by sliding its ends into tracks 180. This allows the entire contoured connecting structure 178 to be removed from the container for use separately, make room in the container, or to be replaced with a different connecting structure. On the other side of the container a straight removable connecting structure 182 is inserted into tracks 180 within the container, to dispose the straight removable connecting structure 182 at an angle with respect to the side of the container. This angle means that there is a wider end, into which larger combs can be stored, and a narrower end, into which smaller combs can be stored. This also follows the general dimensions of the hair clipper 52 which is wider at its cutting end and narrower at its cord end. The contoured storage container 176 includes a cord divider 184 with the opposing set of tracks 180. This cord divider 184 includes a narrow opening that leads into a smaller cord storage compartment 186. In this way the entire hair clipper kit is neatly and securely organized within the contoured storage container 176.

Figure 51:
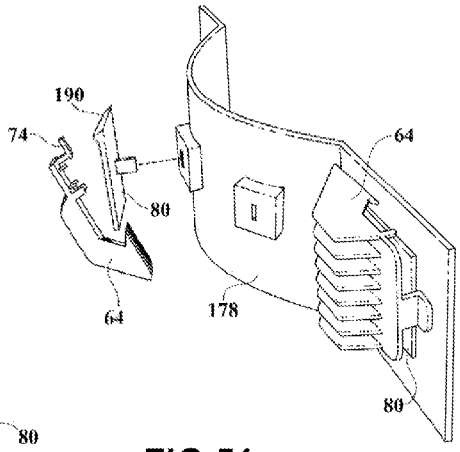
FIG. 51 is a perspective view of the contoured connecting structure 178 from FIG. 50 which further illustrates the sloped rear edge 190.

FIG. 51 shows the contoured connecting structure 178 separately. The non linear structure would also allow it to be freestanding on a horizontal surface, as the backless side by side comb organizer 154 did on its angled base 156. FIG. 51 also shows an attachment guide comb 64 attached to the contoured connecting structure 178 oriented with the teeth 64 in line with the side of the contoured connecting structure 178, where in FIG. 50 the other attachment guide combs 64 are shown attached with the teeth 64 perpendicular to the side of the contoured connecting structure 178. Attaching the combs in either fashion has its advantages. Attaching the combs with the teeth perpendicular to the bottom of the container allows the rear latch to be positioned for easy access, or in the case of open back attachment guide combs it allows the combs to be easily lifted up and out without interference. Positioning the combs with the teeth parallel to the bottom of the container allows the depth of the container which the combs require to be uniform, as the attachment guide combs are all generally the same width.

Figure 52:
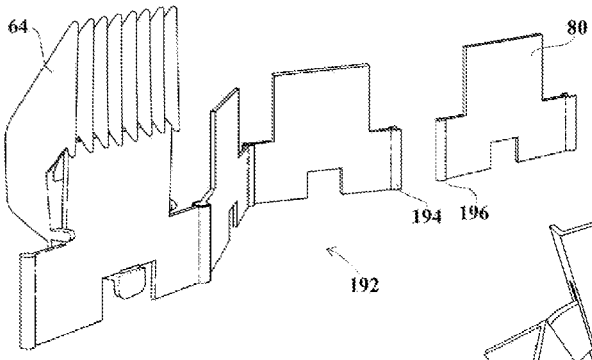
FIG. 52 is a perspective view of the chain connecting structure 192 of the present invention with dummy blades 80 which include couplers 194 and posts 196 with one attachment guide comb 64 attached.

FIG. 52 also illustrates the sloped rear edge 190. A dummy blade 80 is shown removed with an attachment guide comb 64 in position to be attached to it. The sloped rear edge 190 would allow an attachment guide comb 64 having a rear latch 74 to be attached to the dummy blade 80 by simply placing the leading edge into the V-shaped groove and pressing on the comb back, which would push the rear latch 74 against the slope of the sloped rear edge 190, bending it out to engage the sloped rear edge 190. This would allow the attachment guide comb 64 to be more easily attached without directly manipulating the rear latch 74. While this is often possible without a sloped rear edge, as the ridge on the rear latch 74 is often sloped, but having the sloped rear edge 190 would enhance the ease of quickly attaching the attachment guide combs 64.

FIG. 52 shows the chain connecting structure 192 with dummy blades 80 integrated with a coupler 194 on one side and a post 196 on the other side. By inserting the post 196 into the coupler 194 a chain of a chosen number of dummy blades 80 can be linked together thereby allowing the same number of attachment guide combs 64 to be stored. The coupler 194 and post 196 connection would also allow the dummy blades 80 to pivot in relation to one another. This flexibility would allow the chain of stored attachment guide combs to be rearranged to conform to any space.

Figure 53:
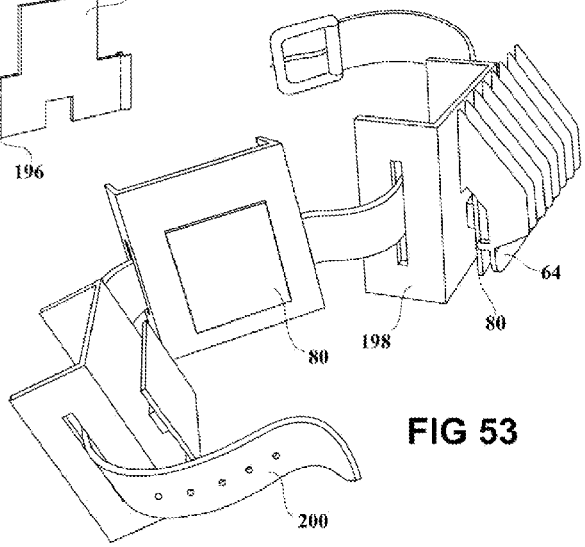
FIG. 53 is a perspective view of three slotted support structures 198 of the present invention, with dummy blades 80, and interconnected by a fabric strap 200, one attachment guide comb 64 is shown attached.

FIG. 53 shows several slotted support structures 198 each of which support a dummy blade 80 to which any attachment guide comb 64, or open back attachment guide comb 150, can be attached. A fabric strap 200 is inserted through the slotted support structures 198 to flexibly connect them together. In this way attachment guide combs 64 could be stored in a variety of ways including on a belt or apron for easy access.

Figure 54:
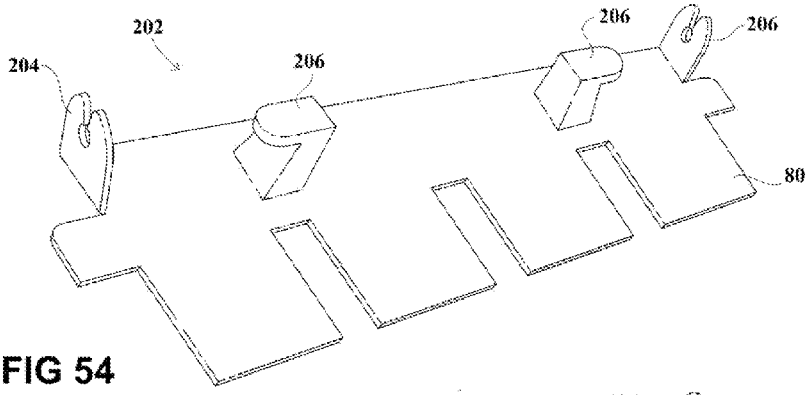
FIG. 54 is a perspective view of the comb plus cord organizer 202.
Figure 55:
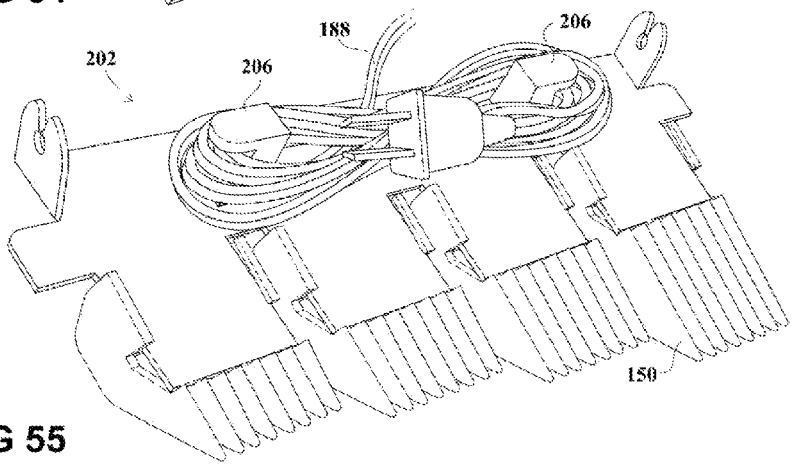
FIG. 55 is a perspective view of the comb plus cord organizer 202 from FIG. 54 with a cord 188 and four attachment guide combs 64 attached.
Figure 57:
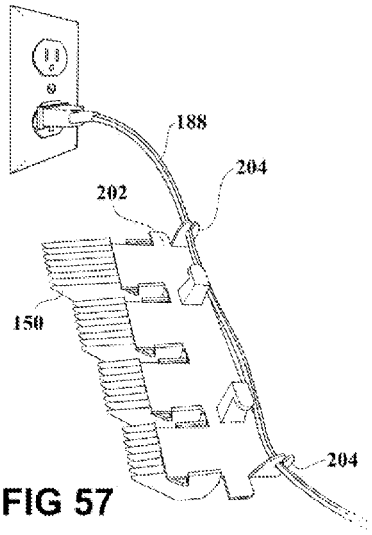
FIG. 57 is a perspective view of the comb plus cord organizer 202, with three attachment guide combs 64, clipped by its cord clips 204 to a cord 188 which is plugged into an electrical outlet.
Figure 56:
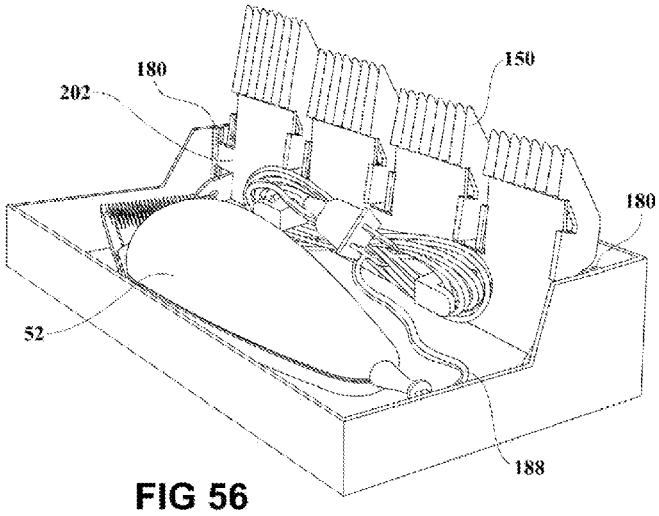
FIG. 56 is a perspective view of the cord plus comb organizer 202 of FIG. 55 organized into a container, with its ends placed into tracks 180, alongside the hair clipper 52.

FIG. 54-57 show the comb plus cord organizer 202 which includes the cord clips 204, which allow the cord 188 to be clipped on, and the cord wrapping posts 206, around which the cord 188 can be wrapped. FIG. 54 shows the comb plus cord organizer 202 alone and FIG. 55 shows the cord plus comb organizer 202 with a clipper's cord wrapped around the cord wrapping posts 206 and four open back attachment guide combs 150 attached (note that this design would work equally well with attachment guide comb 64, with opening 205 provided for the latch 74). Wrapping the cord 188 around the cord wrapping posts 206 in this way would be useful in storing the entire kit as shown in FIG. 56. While in use, with the cord 188 unwound as shown in FIG. 57, the cord clips 204 could be used to attach the comb plus cord organizer 202, with attachment guide combs 64 in place, to the cord for convenient access.

Figure 58:
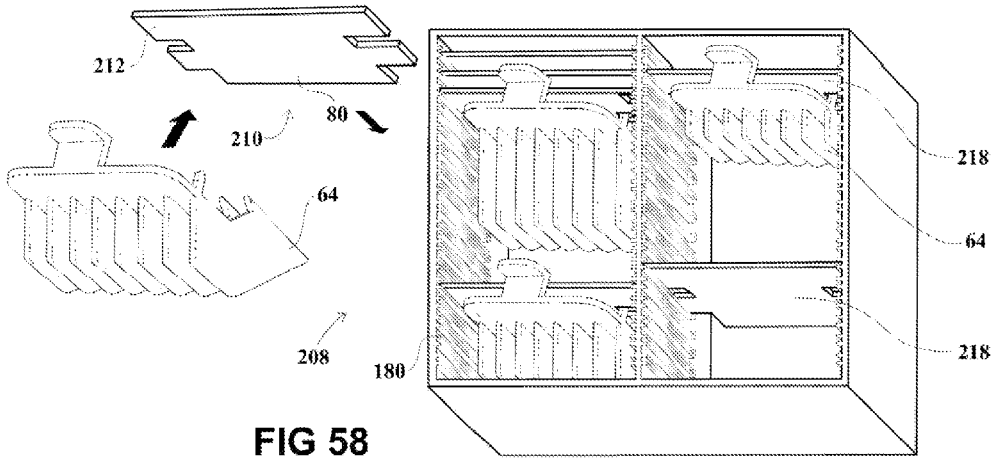
FIG. 58 is a perspective view of the modular comb organizer 208 of the present invention, with a number of dummy blades 80 having extensions 212, which are placed into pairs of tracks 180, some attachment guide combs 64 are shown attached to the dummy blades 80 with a single attachment guide comb 64 and single dummy blade 80 shown removed with arrows indicating how they would be placed within the modular comb organizer 208.

FIG. 58 shows a modular comb organizer 208 which consists of a container with two rows of opposing pairs of tracks 180. The modular forms 210 onto which the attachment guide combs 64 attach are dummy blades 80 with extensions 212 on either side. The modular forms 210 are placed into the container with the extensions 212 sliding into a pair of opposing tracks 180. A large number of closely spaced tracks can be provided within the container to allow for greater placement options for the modular forms 210. Larger combs can be spaced farther apart than are smaller combs and extra modular forms 210 can be spaced one after the other as shown in FIG. 58.

Having the hair clipper 52 and the attachment guide combs 64 interconnected as they are in FIG. 57 is useful in keeping the hair clipper 52 and its attachment guide combs 64 together. It would be additionally advantageous to locate the storage of one or more attachment guide combs 64 in closer proximity to the hair clipper 52. FIGS. 59-64 show dummy blades 80 which are interconnected with the body of the hair clipper 52 so that attachment guide combs can be stored on the clipper itself.

Figure 59:
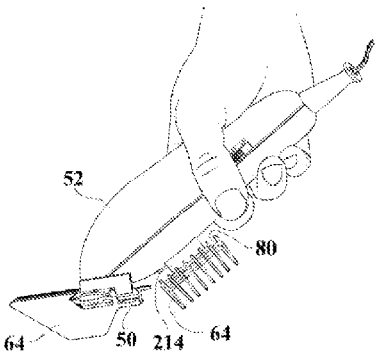
FIG. 59 is a side view of a hair clipper 52 with an attachment guide comb 64 attached to its stationary blade 50, and with a dummy blade 80 connected to the back side of the hair clipper 52 by a fixed clipper mount 214, an attachment guide comb is shown attached to this dummy blade 80 and an operator's hand is shown gripping the hair clipper 52.
Figure 60:
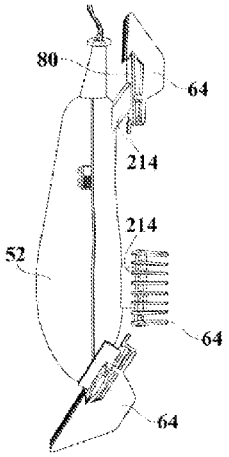
FIG. 60 is a side view of a hair clipper 52 with two dummy blades 80 connected to the back side of the hair clipper 52 by two fixed clipper mounts 214, with attachment guide combs 64 attached to the dummy blades 80 and stationary blade 50.
Figure 61:
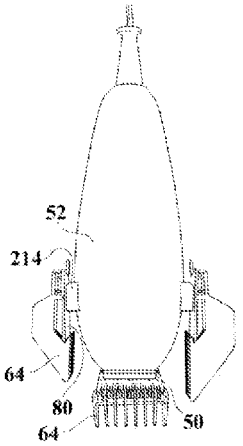
FIG. 61 is a rear view of a hair clipper 52 with an attachment guide comb 64 attached to its stationary blade 50, and with two attachment guide combs 64 attached to two dummy blades 80 connected to each side of the hair clipper 52 by fixed clipper mounts 214.

FIG. 59 shows the hair clipper 52 with an attachment guide comb 64 attached to its stationary blade 50 and to a dummy blade 80 connected to the hair clipper 52 by a fixed clipper mount 214. The fixed clipper mount 214 is connected to the back side of the hair clipper 52 where it would be less likely to interfere with the normal use of the hair clipper 52. FIG. 60 shows an additional attachment guide comb 64 attached to an additional dummy blade 80 connected to another fixed clipper mount 214 at the cord end of the back side of the hair clipper 52. The fixed clipper mounts 214 are spaced out enough to allow for a comfortable hand grip in between. FIG. 61 shows two fixed clipper mounts 214 on each side of the hair clipper 52 with dummy blades 80 and attachment guide combs 64 attached. This arrangement would allow for both an unobstructed view of the cutting area and enough space with which to grip the hair clipper 52.

Figure 62:
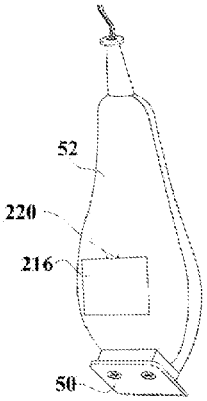
FIG. 62 is a perspective view showing the rear side of a hair clipper 52 with a retractable dummy blade 216, fully retracted, and held in place by a snap 220.
Figure 63:
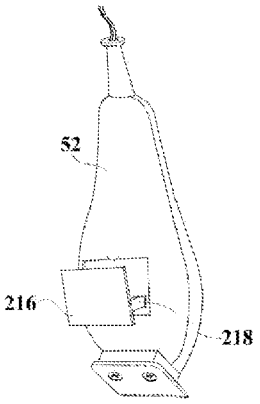
FIG. 63 is the perspective view of the rear side of hair clipper 52 shown in FIG. 63, with the retractable dummy blade 216 extended on retractable supports 218.
Figure 64:
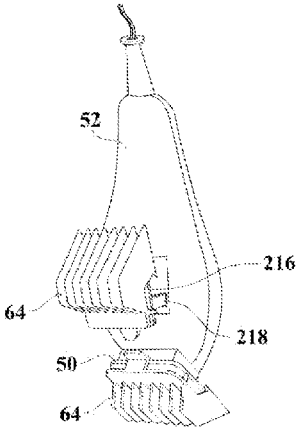
FIG. 64 is the perspective view of the rear side of hair clipper 52 shown in FIG. 63, with attachment guide combs 64 attached to the retractable dummy blade 216 and stationary blade 50.
Figure 65:
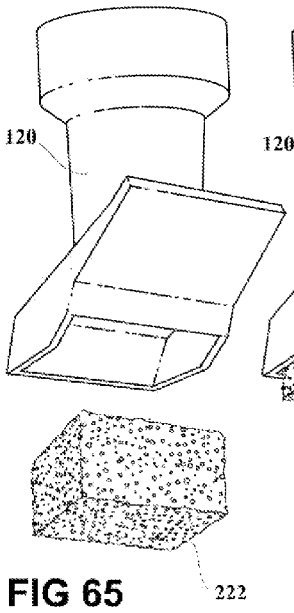
FIG. 65 is a perspective view of the conduit dummy blade 120 of the present invention above the sponge 222.
Figure 66:
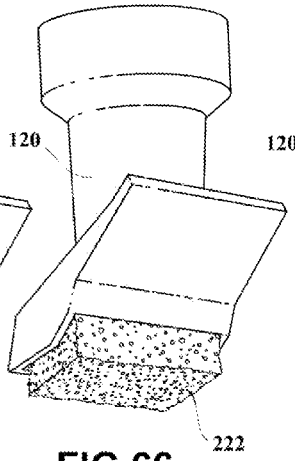
FIG. 66 is a perspective view of the sponge 222 inserted in the conduit dummy blade 120.
Figure 67:
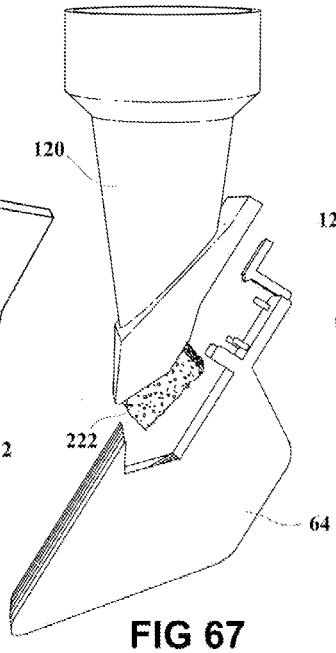
FIG. 67 shows the sponge 222 within the conduit dummy blade 120 prior to its being inserted into the attachment guide comb 64.

FIGS. 62-64 show a hair clipper 52 with a built in retractable dummy blade 216 built into the back side of the hair clipper 52. The retractable dummy blade 216 rotates out of the back of the hair clipper 52 supported on retractable supports 218. While retracted it is held in place by a snap 220. Once extended, as shown in FIG. 63, an attachment guide comb 64 can be attached as shown in FIG. 64. Allowing for the attachment of an open back attachment guide comb 150 would be even simpler, obviating the need for the retractable supports 218, with a retractable dummy blade 216 rotating out with its rear edge remaining within the body of the hair clipper 52. This system would allow for the option of either having an extra attachment guide comb 64 attached or using the hair clipper 52 as normal without any additional obstructions.

Further modifications to the dummy hair the conduit dummy blade 120 and restricted conduit dummy blade 121, which are the focus of the present continuation in part application, are shown in FIGS. 65-72.

Figure 68:
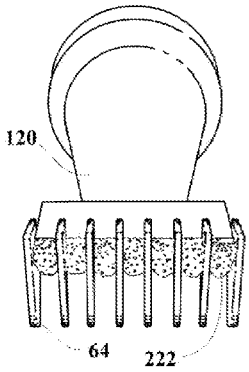
FIG. 68 is a front view of the sponge 222 within the conduit dummy blade 120 after it has been inserted into the attachment guide comb 64 with the sponge 222 pushing between the teeth of the comb 64.

It may be desirable to have a liquid material applied to hair of fur in a gradual manner. Using a material like a sponge which is absorbent, allows liquid to be held in place and stored to a degree until the sponge comes into contact with and object such as hair. This would be advantageous in applying hair die for example. FIGS. 65-68 show the conduit dummy blade 121 with a sponge 222 inserted within it. This would be easy to insert or remove or it could be permanently attached. FIG. 68 shows how the sponge 222 is compressed within the space 870 between the conduit dummy blade 121 and the comb 64 with the sponge 222 pressing out between the teeth of the comb 64. Having the sponge 222 pressing down between the teeth of the comb 64 could aid in applying a liquid to hair or fur. The sponge 222 could also be shaped or be cut to allow for longer pieces of sponge to extend down between the teeth of the comb 64.

Figure 69:
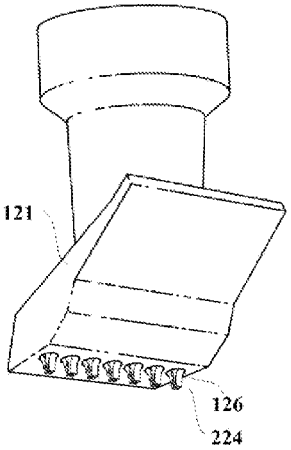
FIG. 69 is a perspective view from the rear and below of the restricted flow conduit dummy blade 121 with a valve 224 in each hole 126.
Figure 70:
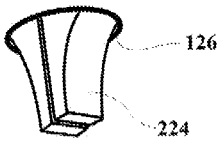
FIG. 70 shows a hole 126 with a valve 224 extending through it in the closed position.
Figure 71:
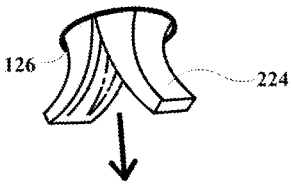
FIG. 71 shows a hole 126 with a valve 224 extending through it in the open position.

Another means of controlling the flow of liquid is the use of nozzles and valves to direct 875 and control the flow of the liquid. FIGS. 69-71 show the restricted conduit dummy blade 121 with a nozzle like valve 224 in each of the holes 126. The valve 224 shown could be made of a flexible material such as rubber and it could be press fit temporarily or permanently attached to the holes 126. The flexibility of the valve 224 would require a certain pressure in the liquid to move the valve from the closed position, shown in FIG. 70 to the open position shown in FIG. 71. This would mean that if the restricted conduit dummy blade 121 was attached to a squeeze bottle of hair treatment that the valves 224 would only open when the bottle was compressed and pressure built up. The valves 224 would prevent the liquid dribbling out in between compressions. Similarly if the restricted conduit dummy blade 121 where attached to a hose and faucet the valves 224 would prevent dripping and leaking until the pressurized flow of water began when the faucet was turned on. The valves 224 could also protrude further from the holes 126 to extend further down between the teeth of the comb 64.

Figure 72:
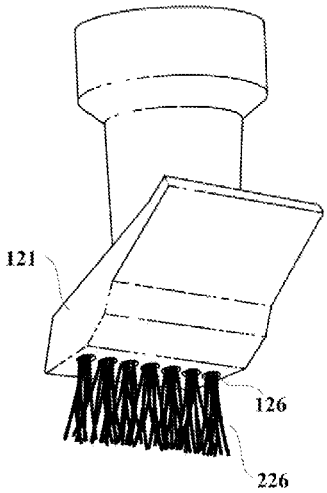
FIG. 72 is a perspective view from the rear and below of the restricted flow conduit dummy blade 121 with bristles 226 extending though each hole 126.

FIG. 72 shows the restricted conduit dummy blade 121 with brush type bristles 226 coming out of each hole 126. These bristles would extending between the teeth of the comb 64 when attached at act to further separate and comb fur or hair as well as to allow for the air or liquid being passed through the restricted conduit dummy blade 121 to be more thoroughly mixed into the fur or hair. In the case of using a vacuum to suck air up through the restricted conduit dummy blade 121 the bristles would aid in dislodging dirt and debris. Also as with the sponge 222 the bristles 226 can hold an be charged with a liquid, releasing it when they come into contact with the fur or hair. Alternatively the bristles shown could be adjacent to the holes 126 or to the valves 224.

It is also important to note the advantage of having the opening of the conduit dummy blade 120 and the holes 126 of the restricted conduit dummy blade 121 are confined to the inner structure of the comb by the leading edge 124 terminating within the V-shaped groove of the attachment guide comb, and the width of the conduit dummy blade 120 being no greater than the that of the attachment guide comb. This means that the suction of a vacuum, the blowing of air, or the dispensing of liquid are all focused through the comb and take full advantage of being restricted to the spaces between the combs teeth. This means that the vacuum's suction in stronger and quieter, the blown air is more powerful, and the liquid's movement is controlled and focused to within the combs teeth.

None of the specifics of the detailed description above should be construed as limiting the scope of the invention. They are in fact not necessarily the preferred embodiments (as mentioned the guide comb organizer would be most practically produced as a single integral piece and was describe in parts for the sake of clarity).

Thus, the scope of the invention should be determined by the following claims and their legal equivalents, rather than by the examples given.

Having thus described the invention, I claim:

1. An attachment guide comb conduit comprising:

a) an attachment guide comb, said attachment guide comb comprising a comb back, a plurality of planar teeth, a plurality of said planar teeth having a V-shaped notch, said planar teeth being perpendicularly attached to said comb back, said planar teeth being arranged in a row comprising a plurality of inner teeth and two outermost teeth, said V-shaped notches being aligned forming a V-shaped groove, a plurality of abutments comprising at least two abutments with abutting surfaces perpendicular to said V-shaped groove at said outermost teeth; and b) at least one form, said form comprising a plurality of surfaces, including a continuous leading edge configured to engage with said attachment guide comb, said form being releasably attachable to said attachment guide comb by an attachment means wherein said form abuts said abutments and said leading edge is at least partially engaging and disposed within said V-shaped groove, said form further comprising an underside, said underside not extending farther forward than said leading edge, said underside comprising at least one aperture, said form further comprising a first conduit within said form, said aperture connecting with said first conduit, whereby said attachment guide comb can be secured to said form, said form can be connected to a source of air or fluid which is then passed through said form and between said teeth.

2. The attachment guide comb conduit of claim 1 wherein said form further comprises a conical pipe and a conduit socket.

3. The attachment guide comb conduit of claim 1 wherein said form further comprises a sponge at least partially in-between said aperture and said teeth.

4. The attachment guide comb conduit of claim 3 wherein said sponge extends at least partially between said teeth.

5. The attachment guide comb conduit of claim 1 wherein said form comprises a plurality apertures, said apertures configured to direct fluent material between said teeth.

6. The attachment guide comb conduit of claim 5 wherein said apertures each further comprise a valve, said valve being configured to be in a closed position when there is a low pressure behind said valve and to be in an open position when there is a high pressure behind said valve.

7. The attachment guide comb conduit of claim 1 wherein said form further comprises at least one valve.

8. The attachment guide comb conduit of claim 1 wherein said form further comprises bristles extending from said underside between said teeth.

9. The attachment guide comb conduit of claim 8 wherein said bristles are adjacent to said aperture.

10. The attachment guide comb conduit of claim 8 wherein said bristles pass through said aperture.

11. The attachment guide comb conduit of claim 1 further comprising a fluid reservoir, said fluid reservoir being connected to said form, whereby said fluid can pass through said form and between said teeth.

12. The attachment guide comb conduit of claim 1 further comprising an air blower, said air blower further comprising a hose, said form further comprising a conduit socket, said hose being connected to said conduit socket, whereby said air blower blows air through said hose, through said form and between said teeth.

13. The attachment guide comb conduit of claim 1 further comprising a vacuum, said vacuum further comprising hose, said form further comprising a conduit socket, said hose being connected to said conduit socket whereby said vacuum sucks air through said hose, through said form and up between said teeth.

14. An attachment guide comb conduit set comprising:

a) a plurality of attachment guide combs, each said attachment guide comb comprising a comb back, a plurality of planar teeth, the plurality of said planar teeth having a V-shaped notch, said planar teeth being perpendicularly attached to said comb back, said planar teeth being arranged in a row comprising a plurality of inner teeth and two outermost teeth, said V-shaped notches being aligned forming a V-shaped groove, a plurality of abutments comprising at least first and a second abutments with abutting surfaces perpendicular to said V-shaped groove at said outermost teeth, a first distance being between said first abutment and said second abutment, said plurality of attachment guide combs including a plurality of varying sizes defined by the length of said teeth; and b) at least one form, said form comprising a plurality of surfaces, including a continuous leading edge configured to engage with said attachment guide comb, said form being releasably attachable to said attachment guide comb by an attachment means wherein said form abuts said abutments and said leading edge is at least partially engaging and disposed within said V-shaped groove, said form having a width congruent to said first distance, said form further comprising an underside, said underside not extending farther forward than said leading edge, said underside not being wider than said first distance, said underside comprising at least one aperture, said form further comprising a conduit within said form, said aperture connecting with said conduit, said form further comprising a means for connecting with an end of a hose; and c) one of said attachment guide combs being releasably attached to said form; and d) a hose for the transmission of fluent matter comprising a housing and an inner conduit; and e) said hose for transmission being connected to said means for connecting, whereby fluent matter can pass through said hose for transmission, through said form and between said teeth.

15. The attachment guide comb conduit of claim 14 wherein said form further comprises a sponge at least partially in-between said aperture and said teeth.

16. The attachment guide comb conduit of claim 14 wherein said form comprises a plurality of apertures, said apertures configured to direct fluent material between said teeth, said apertures each further comprises a valve, said valve being configured to be in a closed position when there is a low pressure behind said valve and to be in an open position when there is a high pressure behind said valve.

17. The attachment guide comb conduit of claim 14 further comprising a vacuum, said vacuum further comprising a hose, said form further comprising a conduit socket, said hose being connected to said conduit socket, whereby said vacuum sucks air through said hose, through said form and up between said teeth.

18. A method for passing fluent matter through hair comprising the steps of:

providing an object which has skin and hair growing on the skin;

providing an attachment guide comb comprising teeth, said attachment guide comb being configured to attach to a hair clipper;

providing a form configured to be compatible with said attachment guide comb and further comprising a conduit means;

providing a supply of fluent matter;

attaching said attachment guide comb to said form, connecting said supply of fluent matter to said form, bringing said teeth into contact with said skin and thereby disposing said hair between said teeth and allowing said fluent matter to pass through said form, between said teeth and through said hair.

19. The method of claim 18 wherein said form further comprises a valve, said valve being opened to allow said fluent matter to pass through said form.

20. The method of claim 18 wherein said form further comprises a conduit socket, said supply of fluent matter comprises a compatible structure configured to engage said conduit socket, said compatible structure connecting said supply of fluent matter to said form including said compatible structure of said supply of fluent matter being connected to said conduit socket.

21. The method of claim 18 wherein a plurality of attachment guide combs is provided, said plurality of attachment guide combs each comprising teeth of varying lengths, said hair comprising a length, said method comprising first selecting an attachment guide comb closest to said length of the hair.

* * * * *